US010998628B2

(12) United States Patent
Chen et al.

(10) Patent No.: US 10,998,628 B2
(45) Date of Patent: May 4, 2021

(54) MODULATION PATTERNS FOR SURFACE SCATTERING ANTENNAS

(71) Applicant: Searete LLC, Bellevue, WA (US)

(72) Inventors: Pai-Yen Chen, Houston, TX (US); Tom Driscoll, San Diego, CA (US); Siamak Ebadi, Redmond, WA (US); John Desmond Hunt, Seattle, WA (US); Nathan Ingle Landy, Seattle, WA (US); Melroy Machado, Seattle, WA (US); Milton Perque, Jr., Seattle, WA (US); David R. Smith, Durham, NC (US); Yaroslav A. Urzhumov, Bellevue, WA (US)

(73) Assignee: Searete LLC, Bellevue, WA (US)

( * ) Notice: Subject to any disclaimer, the term of this patent is extended or adjusted under 35 U.S.C. 154(b) by 543 days.

(21) Appl. No.: 15/723,863

(22) Filed: Oct. 3, 2017

(65) Prior Publication Data

US 2018/0108992 A1 Apr. 19, 2018

Related U.S. Application Data

(63) Continuation of application No. 15/010,140, filed on Jan. 29, 2016, now Pat. No. 9,806,415, which is a continuation of application No. 14/510,947, filed on Oct. 9, 2014, now abandoned.

(60) Provisional application No. 62/015,293, filed on Jun. 20, 2014.

(51) Int. Cl.

| | |
|---|---|
| ***H01Q 3/44*** | (2006.01) |
| ***H01Q 11/02*** | (2006.01) |
| ***H01Q 13/20*** | (2006.01) |

(52) U.S. Cl.
CPC ..... *H01Q 3/44* (2013.01); *H01Q 11/02* (2013.01); *H01Q 13/20* (2013.01)

(58) Field of Classification Search
CPC ..... H01Q 3/44; H01Q 11/02; H01Q 13/20
See application file for complete search history.

(56) References Cited

U.S. PATENT DOCUMENTS

| | | | |
|---|---|---|---|
| 3,001,193 | A | 9/1961 | Marie |
| 3,604,012 | A | 9/1971 | Lindley |
| 3,714,608 | A | 1/1973 | Barnes et al. |
| 4,150,382 | A | 4/1979 | King |
| 4,291,312 | A | 9/1981 | Kaloi |

(Continued)

FOREIGN PATENT DOCUMENTS

| | | | |
|---|---|---|---|
| CN | 101038983 | A | 9/2007 |
| CN | 102946006 | A | 2/2013 |

(Continued)

OTHER PUBLICATIONS

Chinese State Intellectual Property Office, First Office Action, App. No. 201480074759.2 (based on PCT Patent Application No. PCT/US2014/069254); dated Jul. 2, 2018; pp. 1-14 (machine translation provided).

(Continued)

*Primary Examiner* — Dimary S Lopez Cruz
*Assistant Examiner* — Michael M Bouizza
(74) *Attorney, Agent, or Firm* — Phillips Winchester; Justin K. Flanagan

(57) ABSTRACT

Modulation patterns for surface scattering antennas provide desired antenna pattern attributes such as reduced side lobes and reduced grating lobes.

14 Claims, 14 Drawing Sheets

(56) References Cited

U.S. PATENT DOCUMENTS

| | | | |
|---|---|---|---|
| 4,489,325 | A | 12/1984 | Bauck et al. |
| 4,509,209 | A | 4/1985 | Itoh et al. |
| 4,672,378 | A | 6/1987 | Drabowitch et al. |
| 4,874,461 | A | 10/1989 | Sato et al. |
| 4,920,350 | A | 4/1990 | McGuire et al. |
| 4,978,934 | A | 12/1990 | Saad |
| 5,043,738 | A | 8/1991 | Shapiro et al. |
| 5,512,906 | A | 4/1996 | Speciale |
| 5,889,599 | A | 3/1999 | Takemori |
| 6,061,023 | A | 5/2000 | Daniel et al. |
| 6,075,483 | A | 6/2000 | Gross |
| 6,084,540 | A | 7/2000 | Yu |
| 6,114,834 | A | 9/2000 | Parise |
| 6,166,690 | A | 12/2000 | Lin et al. |
| 6,198,453 | B1 | 3/2001 | Chew |
| 6,211,823 | B1 | 4/2001 | Herring |
| 6,232,931 | B1 | 5/2001 | Hart |
| 6,313,803 | B1 | 11/2001 | Manasson et al. |
| 6,366,254 | B1 | 4/2002 | Sievenpiper et al. |
| 6,384,797 | B1 | 5/2002 | Schaffner et al. |
| 6,469,672 | B1 | 10/2002 | Marti-Canales et al. |
| 6,552,696 | B1 | 4/2003 | Sievenpiper et al. |
| 6,633,026 | B2 | 10/2003 | Tuominen |
| 6,636,179 | B1 | 10/2003 | Woo et al. |
| 7,068,234 | B2 | 6/2006 | Sievenpiper |
| 7,151,499 | B2 | 12/2006 | Avakian et al. |
| 7,154,451 | B1 | 12/2006 | Sievenpiper |
| 7,162,250 | B2 | 1/2007 | Misra |
| 7,253,780 | B2 | 8/2007 | Sievenpiper |
| 7,307,596 | B1 | 12/2007 | West |
| 7,456,787 | B2 | 11/2008 | Manasson et al. |
| 7,609,223 | B2 | 10/2009 | Manasson et al. |
| 7,667,660 | B2 | 2/2010 | Manasson et al. |
| 7,830,310 | B1 | 11/2010 | Sievenpiper et al. |
| 7,864,112 | B2 | 1/2011 | Manasson et al. |
| 7,911,407 | B1 | 3/2011 | Fong et al. |
| 7,995,000 | B2 | 8/2011 | Manasson et al. |
| 8,040,586 | B2 | 10/2011 | Smith et al. |
| 8,059,051 | B2 | 11/2011 | Manasson et al. |
| 8,134,521 | B2 | 3/2012 | Herz et al. |
| 8,179,331 | B1 | 5/2012 | Sievenpiper |
| 8,212,739 | B2 | 7/2012 | Sievenpiper |
| 8,339,320 | B2 | 12/2012 | Sievenpiper |
| 8,456,360 | B2 | 6/2013 | Manasson et al. |
| 9,385,435 | B2 | 7/2016 | Bily et al. |
| 9,450,310 | B2 | 9/2016 | Bily et al. |
| 2002/0167456 | A1 | 11/2002 | McKinzie, III |
| 2003/0016180 | A1* | 1/2003 | James ..... H01Q 13/20 343/770 |
| 2003/0214443 | A1 | 11/2003 | Bauregger et al. |
| 2004/0227668 | A1 | 11/2004 | Sievenpiper |
| 2004/0263408 | A1 | 12/2004 | Sievenpiper et al. |
| 2005/0031295 | A1 | 2/2005 | Engheta et al. |
| 2006/0065856 | A1 | 3/2006 | Diaz et al. |
| 2006/0114170 | A1 | 6/2006 | Sievenpiper |
| 2006/0116097 | A1 | 6/2006 | Thompson |
| 2006/0187126 | A1 | 8/2006 | Sievenpiper |
| 2007/0085757 | A1 | 4/2007 | Sievenpiper |
| 2007/0159395 | A1 | 7/2007 | Sievenpiper et al. |
| 2007/0159396 | A1 | 7/2007 | Sievenpiper et al. |
| 2007/0176846 | A1 | 8/2007 | Vazquez et al. |
| 2007/0182639 | A1 | 8/2007 | Sievenpiper et al. |
| 2007/0200781 | A1 | 8/2007 | Ahn et al. |
| 2008/0180339 | A1 | 7/2008 | Yagi |
| 2008/0224707 | A1 | 9/2008 | Wisler et al. |
| 2008/0268790 | A1 | 10/2008 | Shi et al. |
| 2008/0316088 | A1 | 12/2008 | Pavlov et al. |
| 2009/0002240 | A1 | 1/2009 | Sievenpiper et al. |
| 2009/0109121 | A1 | 4/2009 | Herz et al. |
| 2009/0251385 | A1 | 10/2009 | Xu et al. |
| 2010/0066629 | A1 | 3/2010 | Sievenpiper |
| 2010/0073261 | A1 | 3/2010 | Sievenpiper |
| 2010/0134370 | A1 | 6/2010 | Oh et al. |
| 2010/0156573 | A1 | 6/2010 | Smith et al. |
| 2010/0188171 | A1 | 7/2010 | Mohajer-Iravani et al. |
| 2010/0279751 | A1 | 11/2010 | Pourseyed et al. |
| 2010/0328143 | A1 | 12/2010 | Zoughi et al. |
| 2011/0065448 | A1 | 3/2011 | Song et al. |
| 2011/0117836 | A1 | 5/2011 | Zhang et al. |
| 2011/0151789 | A1 | 6/2011 | Viglione et al. |
| 2011/0267664 | A1 | 11/2011 | Kitamura et al. |
| 2012/0026068 | A1 | 2/2012 | Sievenpiper |
| 2012/0194399 | A1 | 8/2012 | Bily et al. |
| 2012/0219249 | A1 | 8/2012 | Pitwon |
| 2012/0268340 | A1 | 10/2012 | Capozzoli et al. |
| 2012/0280770 | A1 | 11/2012 | Abhari et al. |
| 2013/0069865 | A1 | 3/2013 | Hart |
| 2013/0249310 | A1 | 9/2013 | Hyde et al. |
| 2013/0278211 | A1 | 10/2013 | Cook et al. |
| 2013/0324076 | A1 | 12/2013 | Harrang |
| 2014/0217269 | A1* | 8/2014 | Guo ..... G02B 6/2934 250/227.14 |
| 2014/0266946 | A1 | 9/2014 | Bily et al. |
| 2015/0189568 | A1 | 7/2015 | Stanze et al. |
| 2017/0250746 | A1 | 8/2017 | Wang et al. |

FOREIGN PATENT DOCUMENTS

| | | | |
|---|---|---|---|
| CN | 103222109 | A | 7/2013 |
| JP | 06-090110 | | 3/1994 |
| JP | 2007-081825 | A | 3/2007 |
| JP | 2008-054146 | A | 3/2008 |
| JP | 2008054146 | A | 3/2008 |
| JP | 2010147525 | A | 7/2010 |
| JP | 2010-187141 | A | 8/2010 |
| JP | 2012085145 | A | 4/2012 |
| KR | 10-1045585 | B1 | 6/2011 |
| WO | WO 2008-007545 | A1 | 1/2008 |
| WO | WO 2008/059292 | A2 | 5/2008 |
| WO | WO 2009/103042 | A2 | 8/2009 |
| WO | WO 2010/0021736 | | 2/2010 |
| WO | WO 2012/050614 | A1 | 4/2012 |
| WO | PCT/US2013/212504 | | 5/2013 |
| WO | WO 2013/147470 | A1 | 10/2013 |

OTHER PUBLICATIONS

European Patent Office, Communication Pursuant to Article 94(3) EPC; App. No. EP 15808884.9; dated Oct. 17, 2019; pp. 1-6.

European Patent Office, Communication Pursuant to Article 94(3) EPC; App. No. EP 15786229.1; dated Oct. 17, 2019; pp. 1-6.

Checcacci et al.; "A Holographic VHF Antenna"; IEEE Transactions on Antennas and Propagation; Mar. 1971; pp. 278-279.

Elsherbiny et al.; "Holographic Antenna Concept, Analysis, and Parameters"; IEEE Transactions on Antennas and Propagation; Mar. 2004; pp. 830-839; vol. 52; No. 3; 2004 IEEE.

Iizuka et al.; "Volume-Type Holographic Antenna"; IEEE Transactions on Antennas and Propagation; Nov. 1975; pp. 807-810.

Sazonov, Dimitry M.; "Computer Aided Design of Holographic Antennas"; IEEE 1999; pp. 738-741.

Chen, Hou-Tong; "A review of metasurfaces; physics and applications"; Reports on Progress in Physics; Mar. 9, 2016; pp. 1-60; IOP Publishing Ltd. 2016.

European Patent Office, Communication Pursuant to Article 94(3) EPC; App. No. 14770686.5; dated Mar. 28, 2019; pp. 1-22.

Chinese State Intellectual Property Office, Notification of the First Office Action, App. No. 201580042227.5 (based on PCT Patent Application No. PCT/US2015/036638); dated Sep. 30, 2018; (machine translation provided, 5 pages total).

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494: Hindawi Publishing Corporation.

"Array Antenna with Controlled Radiation Pattern Envelope Manufacture Method"; ESA; Jan. 8, 2013; pp. 1-2; http://www.esa.int/

(56) References Cited

OTHER PUBLICATIONS

Our_Activities/Technology/Array_antenna_with_controlled_radiation_pattern_envelope_manufacture_method.
Belloni, Fabio; "Channel Sounding"; S-72.4210 PG Course in Radio Communications; Bearing a date of Feb. 7, 2006; pp. 1-25.
Chen, Robert; *Liquid Crystal Displays*, Wiley, New Jersey 2011 (not provided).
Chin, J.Y. et al.; "An efficient broadband metamaterial wave retarder"; Optics Express; vol. 17, No. 9; p. 7640-7647; 2009.
Chu, R. S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.
Colburn et al.; "Adaptive Artificial Impedance Surface Conformal Antennas"; in Proc. IEEE Antennas and Propagation Society Int. Symp.; 2009; p. 1-4.
Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.
Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.
Den Boer, Wilem; *Active Matrix Liquid Crystal Displays*; Elsevier, Burlington, MA, 2009 (not provided).
Diaz, Rudy; "Fundamentals of EM Waves"; Bearing a date of Apr. 4, 2013; 6 total pages, located at: http://www.microwaves101.com/encycolpedia/absorbingradarl.cfm.
Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.
Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.
European Patent Office, Supplementary European Search Report, pursuant to Rule 62 EPC; App. No. EP 11 83 2873; dated May 15, 2014; 7 pages.
Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.
Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.
Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.
Frenzel, Lou; "What's the Difference Between EM Near Field and Far Field?"; Electronic Design; Bearing a date of Jun. 8, 2012; 7 total pages; located at: http://electronicdesign.com/energy/what-s-difference-between-em-field-and-far-field.
Grbic, Anthony; "Electrical Engineering and Computer Science"; University of Michigan; Create on Mar. 18, 2014, printed on Jan. 27, 2014; pp. 1-2; located at http;//sitemaker.umich.edu/agrbic/projects.
Grbic et al.; "Metamaterial Surfaces for Near and Far-Field Applications"; 7$^{th}$ European Conference on Antennas and Propagation (EUCAP 2013); Bearing a date of 2013, Created on Mar. 18, 2014; pp. 1-5.
Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.
Imani et al.; "A Concentrically Corrugated Near-Field Plate"; Bearing a date of 2010; Created on Mar. 18, 2014; pp. 1-4; IEEE.
Imani et al.; "Design of a Planar Near-Field Plate"; Bearing at date of 2012, Created on Mar. 18, 2014; pp. 102, IEEE.
Imani et al.; "Planar Near-Field Plates"; Bearing a date of 2013, Create on Mar. 18, 2014; pp. 1-10; IEEE.
Islam et al.; "A Wireless Channel Sounding System for Rapid Propagation Measurements"; Bearing a date of Nov. 21, 2012, 7 total pages.
Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.
Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.
Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.
Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.
Konishi, Yohei; "Channel Sounding Technique Using MIMO Software Radio Architecture"; 12$^{th}$ MCRG Joint Seminar Bearing a date of Nov. 18, 2010; 28 total pages.
Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.
Leveau et al.; "Anti-Jam Protection by Antenna"; GPS World; Feb. 1, 2013; pp. 1-11; North Coast Media LLC; http://gpsworld.com/anti-jam-protection-by_-antenna/.
Lipworth et al.; "Magnetic Metamaterial Superlens for Increase Range Wireless Power Transfer"; Scientific Reports; Bearing a date of January 101, 2014; pp. 1-6; vol. 4, No. 3642.
Luo et al.; "Hig-directivity antenna with small antenna aperture"; Applied Physics Letters; 2009; pp. 193506-1-193506-3; vol. 95; American Institute of Physics.
Manasson et al.; "Electronically Reconfigurable Aperture (ERA): A New Approach for Beam-Steering Technology"; Bearing dates of Oct. 12-15, 2010; pp. 673-679; IEEE.
McLean et al.; "Interpreting Antenna Performance Parameters for EMC Applications: Part 2. Radiation Patter, Gain, and Directivity"; Created on Apr. 1, 2014; pp. 7-17; TDK RF Solutions Inc.
Mitri, F.G.; "Quasi-Gaussian Electromagnetic Beams"; Physical Review A.; Bearing a date of Mar. 11, 2013; p. 1; vol. 87, No. 035804; (Abstract Only).
Ovi et al.; "Symmetrical Slot Loading in Elliptical Microstrip Patch antennas Partially Filled with Mue Negative Metamaterials"; PIERS Proceedings, Moscow, Russia; Aug. 19-23, 2012; pp. 542-545.
Patel, Hasmukh S. et al.; "Generalized Techniques of Harmonic Elimination and Voltage Control in Thyristor Inverters: Part I—Harmonic Elimination"; IEEE Transaction on Industry Applications; vol. IA-9, No. 3, May/Jun. 1973; pp. 310-317; IEEE.
PCT International Search Report; International App. No. PCT/US2014/017454; dated Aug. 28, 2014; pp. 1-4.
PCT International Search Report; International App. No. PCT/US2011/001755; dated Mar. 22, 2012; pp. 1-5.
Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
"Satellite Navigation"; Crosslink; The Aerospace Corporation magazine of advances in aerospace technology; Summer 2002; vol. 3, No. 2; pp. 1-56; The Aerospace Corporation.

(56) References Cited

OTHER PUBLICATIONS

Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.
Siciliano et al.; "25. Multisensor Data Fusion"; Springer Handbook of Robotics; Bearing a date of 2008, Created on Mar. 18, 2014; 27 total pages; Springer.
Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.
Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Smith, David R.; "Recent Progress in Metamaterial and Transformation Optical Design"; NAVAIR Nano/Meta Workshop; Feb. 2-3, 2011; pp. 1-32.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 total pages; Fulton Innovation LLC.
Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
Wallace, John; "Flat 'Metasurface' Becomes Aberration-Free Lens"; Bearoing a date of Aug. 28, 2012; 4 total pages; located at: http://www.laserfocus.world.com/articles/2012/08/flat-metasurface-becomes-aberration-free-lens.html.
"Wavenumber"; Microwave Encyclopedia; bearing a date of Jan. 12, 2008; pp. 1-2 P-N Designs, Inc.
Weil, Carsten et al.; "Tunable Inverted-Microstrip Phase Shifter Device Using Nematic Liquid Crystals"; IEEE MTT-S Digest; 2002; p. 367-370; IEEE.
Yan, Dunbao et al.; "A Novel Polarization Convert Surface Based on Artificial Magnetic Conductor"; Asia-Pacific Microwave Conference Proceedings, 2005.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Yoon et al.; "Realizing Efficient Wireless Power Transfer in the Near-Field Region Using Electrically small Antennas"; Wireless Power Transfer; Principles and Engineering Explorations: Bearing a date of Jan. 25, 2012; pp. 151-172.
Young et al.; "Meander-Line Polarizer"; IEEE Trans. Ant. Prop.; p. 376-378; May 1973.
Zhong, S.S. et al.; "Compact ridge waveguide slot antenna array fed by convex waveguide divider"; Electronics Letters; Oct. 13, 2005; p. 1-2; vol. 41, No. 21; IEEE.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Intellectual Property Office of Singapore Examination Report; Application No. 2013027842; dated Feb. 27, 2015; pp. 1-12.
Jiao, Yong-Chang et al.; A New Low-Side-Lobe Pattern Synthesis Technique for Conformal Arrays; IEEE Transactions on Antennas and Propagation; Jun. 1993; pp. 824-831; vol. 41, No. 6; IEEE.
Patent Office of the Russian Federation (Rospatent) Office Action; Application No. 2013119332/28(028599); dated Oct. 13, 2015; machine translation; pp. 1-5.
PCT International Search Report; International App. No. PCT/US2014/069254; dated Nov. 27, 2015; pp. 1-4.
PCT International Search Report; International App. No. PCT/US2015/036638; dated Oct. 19, 2015; pp. 1-4.
PCT International Search Report; International App. No. PCT/US2015/028781; dated Jul. 27, 2015; pp. 1-3.
PCT International Search Report; International App. No. PCT/US2014/070645; dated Mar. 16, 2015; pp. 1-3.
PCT International Search Report; International App. No. PCT/US2014/070650; dated Mar. 27, 2015; pp. 1-3.
PCT International Search Report; International App. No. PCT/US2014/061485; dated Oct. 21, 2014; pp. 1-3.
The State Intellectual Property Office of P.R. C.; Application No. 201180055705.8; Nov. 4, 2015; pp. 1-11.
The State Intellectual Property Office of P.R. C.; Application No. 201180055705.8; May 6, 2015; pp. 1-11.
Korean Intellectual Property Office, Notice of Preliminary Rejection; dated Oct. 15, 2018 (machine translation provided); pp. 1-5.
European Patent Office, Supplementary European Search Report, Pursuant to Rule 62 EPC; App. No. EP 15 80 8884 ; dated Jan. 9, 2018; pp. 1-12.
Smith et al.; "Composite Medium with Simultaneously Negative Permeability and Permitivity"; Physical Review Letters; May 1, 2000; pp. 4184-4187; vol. 84, No. 18; American Physical Society.
European Patent Office, Communication Pursuant to Article 94(3) EPC; App. No. EP 14872874.4; dated Jul. 16, 2018; pp. 1-8.
European Patent Office, Communication Pursuant to Article 94(3) EPC; App. No. EP 14872595.5; dated Jul. 16, 2018; pp. 1-7.
Chinese State Intellectual Property Office, Notification of the Second Office Action, App. No. 201580042227.5 (based on PCT Patent Application No. PCT/US2015/036638); dated Jun. 19, 2019; pp. 1-7 (machine translation provided, total of 6 pages).
Japan Patent Office, Office Action, App. No. 2016-500314 (based on PCT Patent Application No. PCT/US2014/017454); dated Mar. 6, 2018; pp. 1-4.
Chinese State Intellectual Property Office, First Office Action, App. No. 2015/80036356.3 (based on PCT Patent Application No. PCT/US2015/028781); dated Sep. 5, 2018; machine translation provided, 6 pages total.
Cheon et al.; "Stripline-Fed Aperture-Coupled Patch Array Antenna with Reduced Sidelobe"; Electronics Letters; Sep. 3, 2015; pp. 1402-1403; vol. 51, No. 18.
Mikulasek et al.; "2 × 2 Microstrop Patch Antenna Array Fed by Substrate Integrated Waveguide for Radar Applications"; IEEE Antenna and Wirelress Propagation Letters; 2013; pp. 1287-1290; vol. 12.
European Patent Office, Communication Pursuant to Article 94(3) EPC; App. No. EP 14770686.5; dated Dec. 9, 2019; pp. 1-5.
Korean Intellectual Property Office, Notification of Office Action; App. No. 10-2015-7029586; dated Oct. 11, 2019; pp. 1-2 (machine translation provided).
China National Intellectual Property Administration, Patent Application No. 201580036356.3, Notice of Completion of Formalities for Patent Register dated Sep. 15, 2020, pp. 1-5.
Brazilian Patent Office, Patent Application No. BR112013008959-8, Office Action dated Jul. 31, 2020, pp. 1-4.
Korean Intellectual Property Office, Patent Application No. 10-2015-7029589, Notice of Opinion dated May 11, 2020, pp. 1-6.
Korean Intellectual Property Office, Patent Application No. 10-2015-7029589, Decision for Grant of Patent dated Aug. 25, 2020, pp. 1-6.
State Intellectual Property Office of P.R.C., Patent Application No. 201580042227.5, Notification of Decision of Final Rejection dated Mar. 9, 2020, pp. 1-9.

* cited by examiner

MODULATION PATTERNS FOR SURFACE SCATTERING ANTENNAS

CROSS-REFERENCE TO RELATED APPLICATIONS

U.S. Patent Application No. 61/455,171, entitled SURFACE SCATTERING ANTENNAS, naming NATHAN KUNDTZ ET AL. as inventors, filed Oct. 15, 2010, is related to the present application.

U.S. patent application Ser. No. 13/317,338, entitled SURFACE SCATTERING ANTENNAS, naming ADAM BILY, ANNA K. BOARDMAN, RUSSELL J. HANNIGAN, JOHN HUNT, NATHAN KUNDTZ, DAVID R. NASH, RYAN ALLAN STEVENSON, AND PHILIP A. SULLIVAN as inventors, filed Oct. 14, 2011, is related to the present application.

U.S. patent application Ser. No. 13/838,934, entitled SURFACE SCATTERING ANTENNA IMPROVEMENTS, naming ADAM BILY, JEFF DALLAS, RUSSELL J. HANNIGAN, NATHAN KUNDTZ, DAVID R. NASH, AND RYAN ALLAN STEVEN as inventors, filed Mar. 15, 2013, is related to the present application.

U.S. Patent Application No. 61/988,023, entitled SURFACE SCATTERING ANTENNAS WITH LUMPED ELEMENTS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed May 2, 2014, is related to the present application.

U.S. patent application Ser. No. 14/506,432, entitled SURFACE SCATTERING ANTENNAS WITH LUMPED ELEMENTS, naming PAI-YEN CHEN, TOM DRISCOLL, SIAMAK EBADI, JOHN DESMOND HUNT, NATHAN INGLE LANDY, MELROY MACHADO, JAY MCCANDLESS, MILTON PERQUE, DAVID R. SMITH, AND YAROSLAV A. URZHUMOV as inventors, filed Oct. 3, 2014, is related to the present application.

U.S. Patent Application No. 61/992,699, entitled CURVED SURFACE SCATTERING ANTENNAS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed May 13, 2014, is related to the present application.

The present application claims benefit of priority of U.S. Provisional Patent Application No. 62/015,293, entitled MODULATION PATTERNS FOR SURFACE SCATTERING ANTENNAS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed Jun. 20, 2014, which was filed within the twelve months preceding the filing date of the present application.

All subject matter of all of the above applications is incorporated herein by reference to the extent such subject matter is not inconsistent herewith.

DETAILED DESCRIPTION

Figure 1:
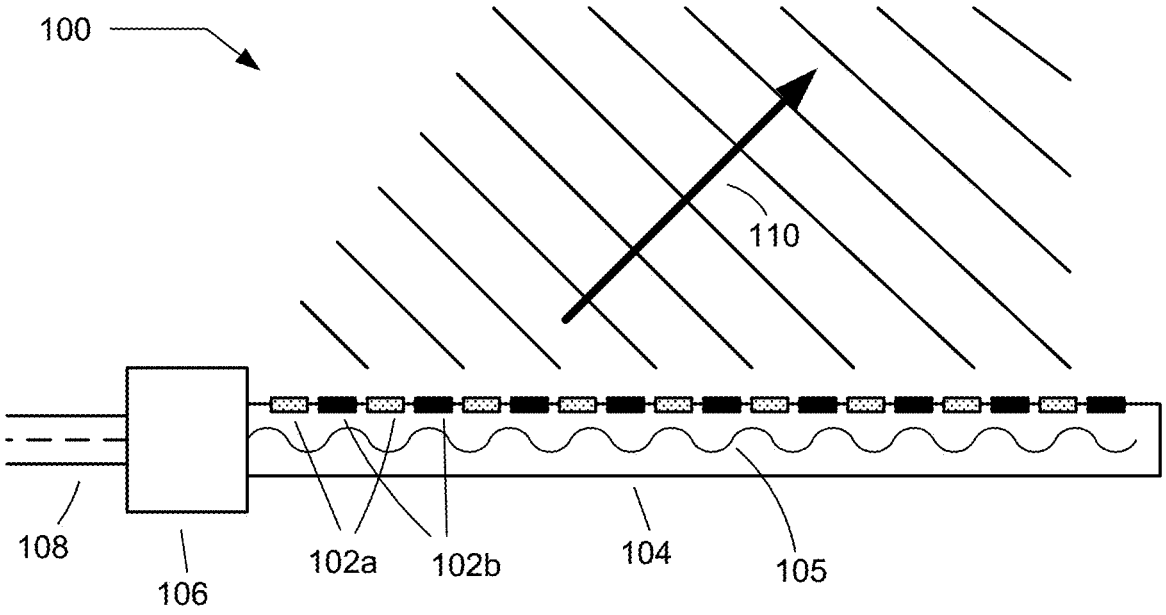
FIG. 1 is a schematic depiction of a surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A schematic illustration of a surface scattering antenna is depicted in FIG. 1. The surface scattering antenna 100 includes a plurality of scattering elements 102*a*, 102*b* that are distributed along a wave-propagating structure 104. The wave propagating structure 104 may be a microstrip, a coplanar waveguide, a parallel plate waveguide, a dielectric rod or slab, a closed or tubular waveguide, a substrate-integrated waveguide, or any other structure capable of supporting the propagation of a guided wave or surface wave 105 along or within the structure. The wavy line 105 is a symbolic depiction of the guided wave or surface wave, and this symbolic depiction is not intended to indicate an actual wavelength or amplitude of the guided wave or surface wave; moreover, while the wavy line 105 is depicted as within the wave-propagating structure 104 (e.g. as for a guided wave in a metallic waveguide), for a surface wave the wave may be substantially localized outside the wave-propagating structure (e.g. as for a TM mode on a single wire transmission line or a "spoof plasmon" on an artificial impedance surface). It is also to be noted that while the disclosure herein generally refers to the guided wave or surface wave 105 as a propagating wave, other embodiments are contemplated that make use of a standing wave that is a superposition of an input wave and reflection(s)s thereof. The scattering elements 102*a*, 102*b* may include scattering elements that are embedded within, positioned on a surface of, or positioned within an evanescent proximity of, the wave-propagation structure 104. For example, the scattering elements can include complementary metamaterial elements such as those presented in D. R. Smith et al, "Metamaterials for surfaces and waveguides," U.S. Patent Application Publication No. 2010/0156573, and A. Bily et al, "Surface scattering antennas," U.S. Patent Application Publication No. 2012/0194399, each of which is herein incorporated by reference. As another example, the scattering elements can include patch elements such as those presented in A. Bily et al, "Surface scattering antenna improvements," U.S. U.S. patent application Ser. No. 13/838,934, which is herein incorporated by reference.

The surface scattering antenna also includes at least one feed connector 106 that is configured to couple the wave-propagation structure 104 to a feed structure 108. The feed structure 108 (schematically depicted as a coaxial cable) may be a transmission line, a waveguide, or any other structure capable of providing an electromagnetic signal that may be launched, via the feed connector 106, into a guided wave or surface wave 105 of the wave-propagating structure 104. The feed connector 106 may be, for example, a coaxial-to-microstrip connector (e.g. an SMA-to-PCB adapter), a coaxial-to-waveguide connector, a mode-matched transition section, etc. While FIG. 1 depicts the feed connector in an "end-launch" configuration, whereby the guided wave or surface wave 105 may be launched from a peripheral region of the wave-propagating structure (e.g. from an end of a microstrip or from an edge of a parallel plate waveguide), in other embodiments the feed structure may be attached to a non-peripheral portion of the wave-propagating structure, whereby the guided wave or surface wave 105 may be launched from that non-peripheral portion of the wave-propagating structure (e.g. from a midpoint of a microstrip or through a hole drilled in a top or bottom plate of a parallel plate waveguide); and yet other embodiments may provide a plurality of feed connectors attached to the wave-propagating structure at a plurality of locations (peripheral and/or non-peripheral).

The scattering elements 102*a*, 102*b* are adjustable scattering elements having electromagnetic properties that are adjustable in response to one or more external inputs. Various embodiments of adjustable scattering elements are described, for example, in D. R. Smith et al, previously cited, and further in this disclosure. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include non-linear magnetic materials), mechanical inputs (e.g. MEMS, actuators, hydraulics), etc. In the schematic example of FIG. 1, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties. Moreover, the particular pattern of adjustment that is depicted in FIG. 1 (i.e. the alternating arrangement of elements 102*a* and 102*b*) is only an exemplary configuration and is not intended to be limiting.

In the example of FIG. 1, the scattering elements 102*a*, 102*b* have first and second couplings to the guided wave or surface wave 105 that are functions of the first and second electromagnetic properties, respectively. For example, the first and second couplings may be first and second polarizabilities of the scattering elements at the frequency or frequency band of the guided wave or surface wave. In one approach the first coupling is a substantially nonzero coupling whereas the second coupling is a substantially zero coupling. In another approach both couplings are substantially nonzero but the first coupling is substantially greater than (or less than) than the second coupling. On account of the first and second couplings, the first and second scattering elements 102*a*, 102*b* are responsive to the guided wave or surface wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as a plane wave 110 that radiates from the surface scattering antenna 100.

The emergence of the plane wave may be understood by regarding the particular pattern of adjustment of the scattering elements (e.g. an alternating arrangement of the first and second scattering elements in FIG. 1) as a pattern that defines a grating that scatters the guided wave or surface wave 105 to produce the plane wave 110. Because this pattern is adjustable, some embodiments of the surface scattering antenna may provide adjustable gratings or, more generally, holograms, where the pattern of adjustment of the scattering elements may be selected according to principles of holography. Suppose, for example, that the guided wave or surface wave may be represented by a complex scalar input wave $\Psi_{in}$ that is a function of position along the wave-propagating structure 104, and it is desired that the surface scattering antenna produce an output wave that may be represented by another complex scalar wave $\Psi_{out}$. Then a pattern of adjustment of the scattering elements may be selected that corresponds to an interference pattern of the input and output waves along the wave-propagating structure. For example, the scattering elements may be adjusted to provide couplings to the guided wave or surface wave that are functions of (e.g. are proportional to, or step-functions of) an interference term given by $\mathrm{Re}[\Psi_{out}\Psi^*_{in}]$. In this way, embodiments of the surface scattering antenna may be adjusted to provide arbitrary antenna radiation patterns by identifying an output wave $\Psi_{out}$ corresponding to a selected beam pattern, and then adjusting the scattering elements accordingly as above. Embodiments of the surface scattering antenna may therefore be adjusted to provide, for example, a selected beam direction (e.g. beam steering), a selected beam width or shape (e.g. a fan or pencil beam having a broad or narrow beamwidth), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing and/or near-field nulls.

Because the spatial resolution of the interference pattern is limited by the spatial resolution of the scattering elements, the scattering elements may be arranged along the wave-propagating structure with inter-element spacings that are much less than a free-space wavelength corresponding to an operating frequency of the device (for example, less than one-third, one-fourth, or one-fifth of this free-space wavelength). In some approaches, the operating frequency is a microwave frequency, selected from frequency bands such as L, S, C, X, Ku, K, Ka, Q, U, V, E, W, F, and D, corresponding to frequencies ranging from about 1 GHz to 170 GHz and free-space wavelengths ranging from millimeters to tens of centimeters. In other approaches, the operating frequency is an RF frequency, for example in the range of about 100 MHz to 1 GHz. In yet other approaches, the operating frequency is a millimeter-wave frequency, for example in the range of about 170 GHz to 300 GHz. These ranges of length scales admit the fabrication of scattering elements using conventional printed circuit board or lithographic technologies.

Figure 2A:
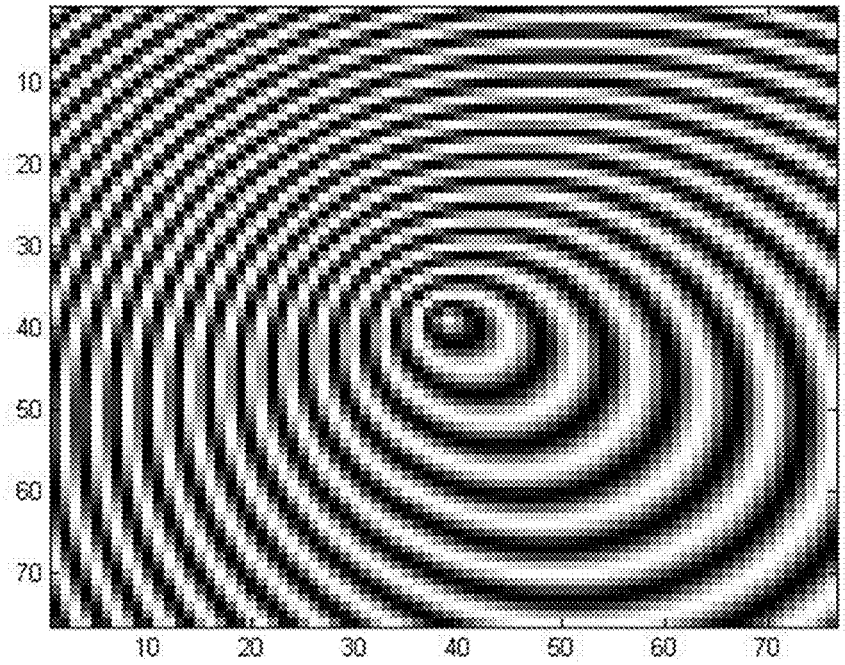
FIGS. 2A and 2B respectively depict an exemplary adjustment pattern and corresponding beam pattern for a surface scattering antenna.
Figure 2B:
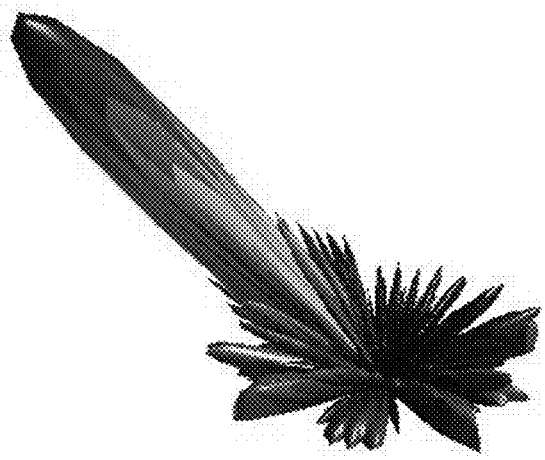
Figure 3A:
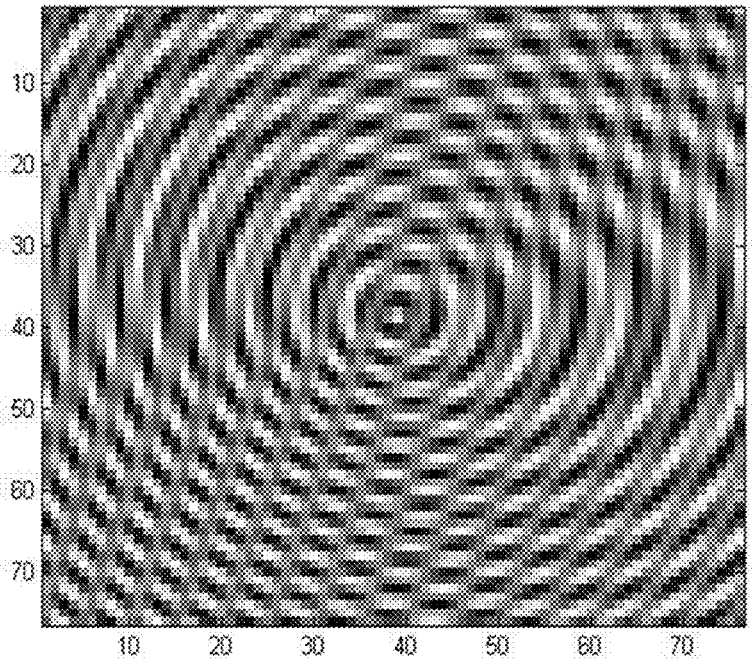
FIGS. 3A and 3B respectively depict another exemplary adjustment pattern and corresponding beam pattern for a surface scattering antenna.
Figure 3B:
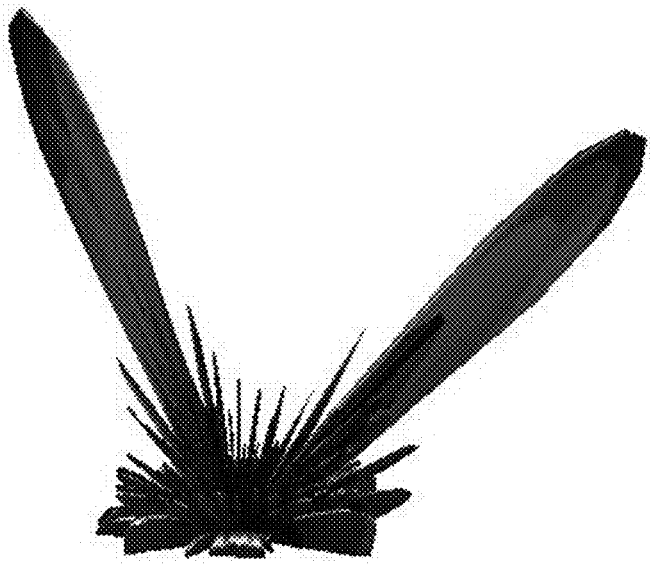
Figure 4A:
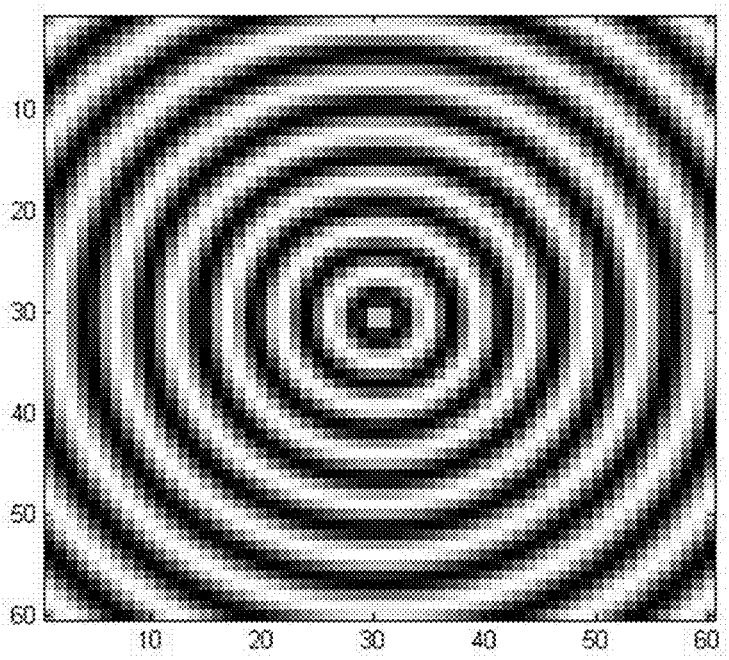
FIGS. 4A and 4B respectively depict another exemplary adjustment pattern and corresponding field pattern for a surface scattering antenna.
Figure 4B:
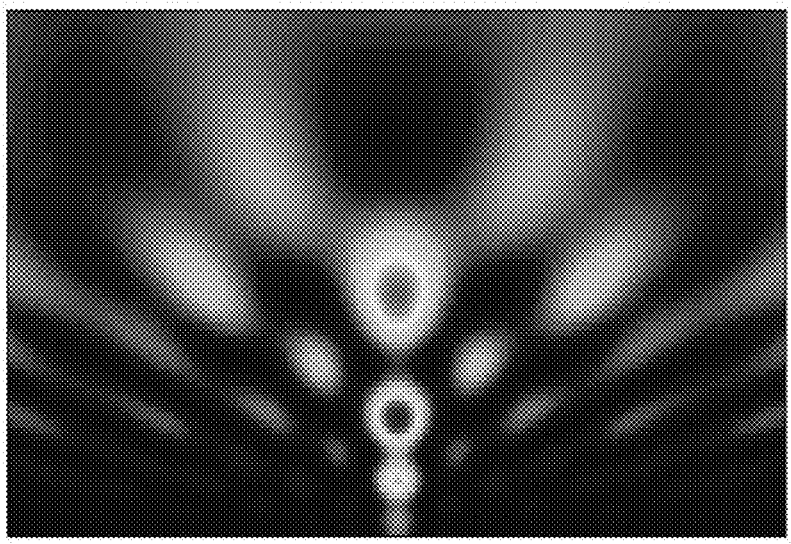

In some approaches, the surface scattering antenna includes a substantially one-dimensional wave-propagating structure 104 having a substantially one-dimensional arrangement of scattering elements, and the pattern of adjustment of this one-dimensional arrangement may provide, for example, a selected antenna radiation profile as a function of zenith angle (i.e. relative to a zenith direction that is parallel to the one-dimensional wave-propagating structure). In other approaches, the surface scattering antenna includes a substantially two-dimensional wave-propagating structure 104 having a substantially two-dimensional arrangement of scattering elements, and the pattern of adjustment of this two-dimensional arrangement may provide, for example, a selected antenna radiation profile as a function of both zenith and azimuth angles (i.e. relative to a zenith direction that is perpendicular to the two-dimensional wave-propagating structure). Exemplary adjustment patterns and beam patterns for a surface scattering antenna that includes a two-dimensional array of scattering elements distributed on a planar rectangular wave-propagating structure are depicted in FIGS. 2A-4B. In these exemplary embodiments, the planar rectangular wave-propagating structure includes a monopole antenna feed that is positioned at the geometric center of the structure. FIG. 2A presents an adjustment pattern that corresponds to a narrow beam having a selected zenith and azimuth as depicted by the beam pattern diagram of FIG. 2B. FIG. 3A presents an adjustment pattern that corresponds to a dual-beam far field pattern as depicted by the beam pattern diagram of FIG. 3B. FIG. 4A presents an adjustment pattern that provides near-field focusing as depicted by the field intensity map of FIG. 4B (which depicts the field intensity along a plane perpendicular to and bisecting the long dimension of the rectangular wave-propagating structure).

In some approaches, the wave-propagating structure is a modular wave-propagating structure and a plurality of modular wave-propagating structures may be assembled to compose a modular surface scattering antenna. For example, a plurality of substantially one-dimensional wave-propagating structures may be arranged, for example, in an interdigital fashion to produce an effective two-dimensional arrangement of scattering elements. The interdigital arrangement may comprise, for example, a series of adjacent linear structures (i.e. a set of parallel straight lines) or a series of adjacent curved structures (i.e. a set of successively offset curves such as sinusoids) that substantially fills a two-dimensional surface area. These interdigital arrangements may include a feed connector having a tree structure, e.g. a binary tree providing repeated forks that distribute energy from the feed structure 108 to the plurality of linear structures (or the reverse thereof). As another example, a plurality of substantially two-dimensional wave-propagating structures (each of which may itself comprise a series of one-dimensional structures, as above) may be assembled to produce a larger aperture having a larger number of scattering elements; and/or the plurality of substantially two-dimensional wave-propagating structures may be assembled as a three-dimensional structure (e.g. forming an A-frame structure, a pyramidal structure, or other multi-faceted structure). In these modular assemblies, each of the plurality of modular wave-propagating structures may have its own feed connector(s) 106, and/or the modular wave-propagating structures may be configured to couple a guided wave or surface wave of a first modular wave-propagating structure into a guided wave or surface wave of a second modular wave-propagating structure by virtue of a connection between the two structures.

In some applications of the modular approach, the number of modules to be assembled may be selected to achieve an aperture size providing a desired telecommunications data capacity and/or quality of service, and/or a three-dimensional arrangement of the modules may be selected to reduce potential scan loss. Thus, for example, the modular assembly could comprise several modules mounted at various locations/orientations flush to the surface of a vehicle such as an aircraft, spacecraft, watercraft, ground vehicle, etc. (the modules need not be contiguous). In these and other approaches, the wave-propagating structure may have a substantially non-linear or substantially non-planar shape whereby to conform to a particular geometry, therefore providing a conformal surface scattering antenna (conforming, for example, to the curved surface of a vehicle).

More generally, a surface scattering antenna is a reconfigurable antenna that may be reconfigured by selecting a pattern of adjustment of the scattering elements so that a corresponding scattering of the guided wave or surface wave produces a desired output wave. Suppose, for example, that the surface scattering antenna includes a plurality of scattering elements distributed at positions $\{r_j\}$ along a wave-propagating structure 104 as in FIG. 1 (or along multiple wave-propagating structures, for a modular embodiment) and having a respective plurality of adjustable couplings $\{\alpha_j\}$ to the guided wave or surface wave 105. The guided wave or surface wave 105, as it propagates along or within the (one or more) wave-propagating structure(s), presents a wave amplitude $A_j$ and phase $\varphi_j$ to the jth scattering element; subsequently, an output wave is generated as a superposition of waves scattered from the plurality of scattering elements:

$$E(\theta, \phi) = \sum_j R_j(\theta, \phi)\alpha_j A_j e^{i\varphi_j} e^{i(k(\theta,\phi)\cdot r_j)}, \tag{1}$$

where $E(\theta, \phi)$ represents the electric field component of the output wave on a far-field radiation sphere, $R_j(\theta, \phi)$ represents a (normalized) electric field pattern for the scattered wave that is generated by the jth scattering element in response to an excitation caused by the coupling $\alpha_j$, and $k(\theta, \phi)$ represents a wave vector of magnitude $\omega/c$ that is perpendicular to the radiation sphere at $(\theta, \phi)$. Thus, embodiments of the surface scattering antenna may provide a reconfigurable antenna that is adjustable to produce a desired output wave $E(\theta, \phi)$ by adjusting the plurality of couplings $\{\alpha_j\}$ in accordance with equation (1).

The wave amplitude $A_j$ and phase $\varphi_j$ of the guided wave or surface wave are functions of the propagation characteristics of the wave-propagating structure 104. Thus, for example, the amplitude $A_j$ may decay exponentially with distance along the wave-propagating structure, $A_j \sim A_0 \exp(-\kappa x_j)$, and the phase $\varphi_j$ may advance linearly with distance along the wave-propagating structure, $\varphi_j \sim \varphi_0 + \beta x_j$, where $\kappa$ is a decay constant for the wave-propagating structure, $\beta$ is a propagation constant (wavenumber) for the wave-propagating structure, and $x_j$ is a distance of the jth scattering element along the wave-propagating structure. These propagation characteristics may include, for example, an effective refractive index and/or an effective wave impedance, and these effective electromagnetic properties may be at least partially determined by the arrangement and adjustment of the scattering elements along the wave-propagating structure. In other words, the wave-propagating structure, in combination with the adjustable scattering elements, may provide an adjustable effective medium for propagation of the guided wave or surface wave, e.g. as described in D. R. Smith et al, previously cited. Therefore, although the wave amplitude $A_j$ and phase $\varphi_j$ of the guided wave or surface wave may depend upon the adjustable scattering element couplings $\{\alpha_j\}$ (i.e. $A_i = A_i(\{\alpha_j\})$, $\varphi_i = \varphi_i(\{\alpha_j\})$), in some embodiments these dependencies may be substantially predicted according to an effective medium description of the wave-propagating structure.

In some approaches, the reconfigurable antenna is adjustable to provide a desired polarization state of the output wave $E(\theta, \phi)$. Suppose, for example, that first and second subsets $LP^{(1)}$ and $LP^{(2)}$ of the scattering elements provide (normalized) electric field patterns $R^{(1)}(\theta,\phi)$ and $R^{(2)}(\theta,\phi)$, respectively, that are substantially linearly polarized and substantially orthogonal (for example, the first and second subjects may be scattering elements that are perpendicularly oriented on a surface of the wave-propagating structure 104). Then the antenna output wave $E(\theta, \phi)$ may be expressed as a sum of two linearly polarized components:

$$E(\theta,\phi)=E^{(1)}(\theta,\phi)+E^{(2)}(\theta,\phi)=\Lambda^{(1)}R^{(1)}(\theta,\phi)+\Lambda^{(2)}R^{(2)}(\theta,\phi), \tag{2}$$

where $$\Lambda^{(1,2)}(\theta, \phi) = \sum_{j \in LP^{(1,2)}} \alpha_j A_j e^{i\varphi_j} e^{i(k(\theta,\phi)\cdot r_j)} \tag{3}$$

are the complex amplitudes of the two linearly polarized components. Accordingly, the polarization of the output wave $E(\theta, \phi)$ may be controlled by adjusting the plurality of couplings $\{\alpha_j\}$ in accordance with equations (2)-(3), e.g. to provide an output wave with any desired polarization (e.g. linear, circular, or elliptical).

Alternatively or additionally, for embodiments in which the wave-propagating structure has a plurality of feeds (e.g. one feed for each "finger" of an interdigital arrangement of one-dimensional wave-propagating structures, as discussed above), a desired output wave $E(\theta, \phi)$ may be controlled by adjusting gains of individual amplifiers for the plurality of feeds. Adjusting a gain for a particular feed line would correspond to multiplying the $A_j$'s by a gain factor G for those elements j that are fed by the particular feed line. Especially, for approaches in which a first wave-propagating structure having a first feed (or a first set of such structures/feeds) is coupled to elements that are selected from $LP^{(1)}$ and a second wave-propagating structure having a second feed (or a second set of such structures/feeds) is coupled to elements that are selected from $LP^{(2)}$, depolarization loss (e.g., as a beam is scanned off-broadside) may be compensated by adjusting the relative gain(s) between the first feed(s) and the second feed(s).

Turning now to a consideration of modulation patterns for surface scattering antennas: recall, as discussed above, that the guided wave or surface wave may be represented by a complex scalar input wave $\Psi_{in}$ that is a function of position along the wave-propagating structure. To produce an output wave that may be represented by another complex scalar wave $\Psi_{out}$, a pattern of adjustments of the scattering elements may be selected that corresponds to an interference pattern of the input and output waves along the wave-propagating structure. For example, the scattering elements may be adjusted to provide couplings to the guided wave or surface wave that are functions of a complex continuous hologram function $h=\Psi_{out}\Psi^*_{in}$.

In some approaches, the scattering elements can be adjusted only to approximate the ideal complex continuous hologram function $h=\Psi_{out}\Psi^*_{in}$. For example, because the scattering elements are positioned at discrete locations along the wave-propagating structure, the hologram function must be discretized. Furthermore, in some approaches, the set of possible couplings between a particular scattering elements and the waveguide is a restricted set of couplings; for example, an embodiment may provide only a finite set of possible couplings (e.g. a "binary" or "on-off" scenario in which there are only two available couplings for each scattering element, or a "grayscale" scenario in which there are N available couplings for each scattering element); and/or the relationship between the amplitude and phase of each coupling may be constrained (e.g. by a Lorentzian-type resonance response function). Thus, in some approaches, the ideal complex continuous hologram function is approximated by an actual modulation function defined on a discrete-valued domain (for the discrete positions of the scattering elements) and having a discrete-valued range (for the discrete available tunable settings of the scattering elements).

Consider, for example, a one-dimensional surface scattering antenna on which it is desired to impose an ideal hologram function defined as a simple sinusoid corresponding to a single wavevector (the following disclosure, relating to the one-dimensional sinusoid, is not intended to be limiting and the approaches set forth are applicable to other two-dimensional hologram patterns). Various discrete modulation functions may be used to approximate this ideal hologram function. In a "binary" scenario where only two values of individual scattering element coupling are available, one approach is to apply a Heaviside function to the sinusoid, creating a simple square wave. Regardless of the density of scattering elements, that Heaviside function will have approximately half the cells on and half off, in a steady repeating pattern. Unlike the spectrally pure sinusoid though, a square wave contains an (infinite) series of higher harmonics. In these approaches, the antenna may be designed so that the higher harmonics correspond to evanescent waves, making them non-radiating, but their aliases do still map into non-evanescent waves and radiate as grating lobes.

Figure 5A:
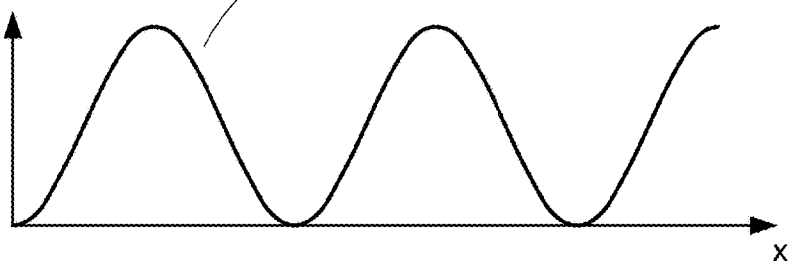
FIGS. 5A-5F depict an example of hologram discretization and aliasing.
Figure 5B:
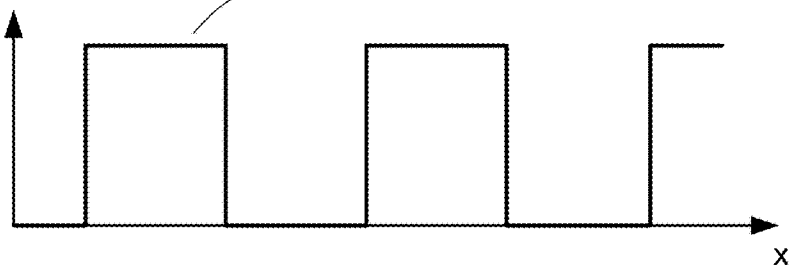
Figure 5C:
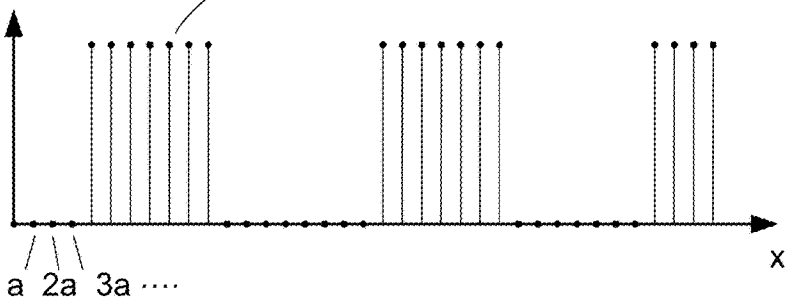
Figure 5D:
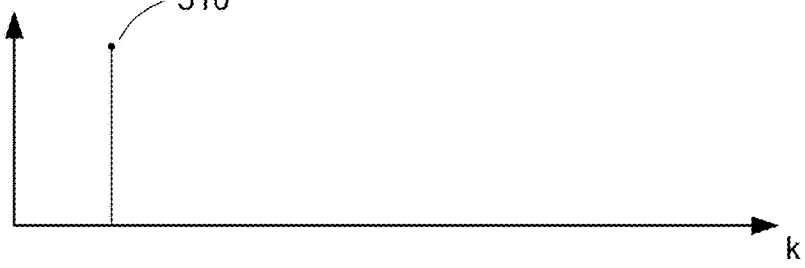
Figure 5E:
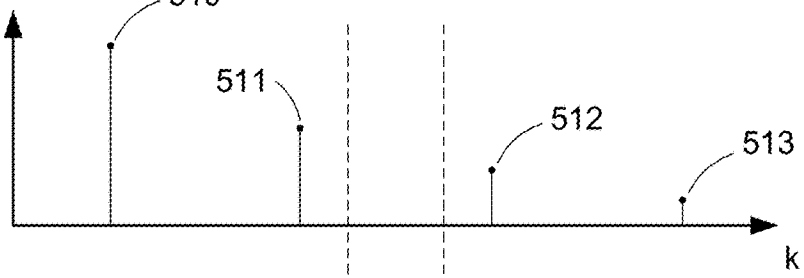

An illustrative example of the discretization and aliasing effect is shown in FIGS. 5A-5F. FIG. 5A depicts a continuous hologram function that is a simple sinusoid 500; in Fourier space, this is represented as a single Fourier mode 510 as shown in FIG. 5D. When the Heaviside function is applied to the sinusoid, the result is a square wave 502 as shown in FIG. 5B; in Fourier space, the square wave includes the fundamental Fourier mode 510 and an (infinite) series of higher harmonics 511, 512, 513, etc. as shown in FIG. 5E. Finally, when the square wave is sampled at a discrete set of locations corresponding to the discrete locations of the scattering elements, the result is a discrete-valued function 504 on a discrete domain, as shown in FIG. 5C (here assuming a lattice constant a).

Figure 5F:
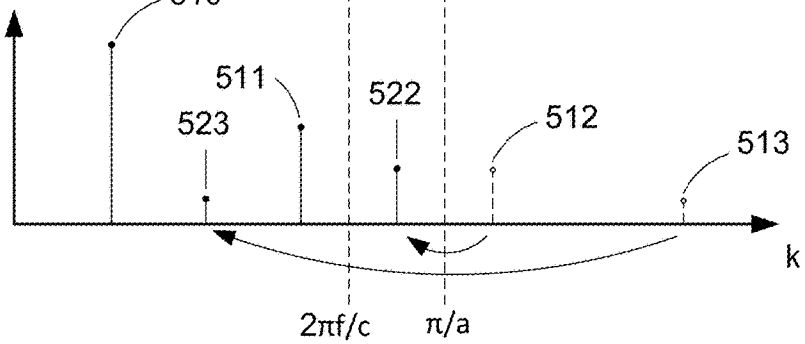

The sampling of the square wave at a discrete set of locations leads to an aliasing effect in Fourier space, as shown in FIG. 5F. In this illustration, the sampling with a lattice constant a leads to a "folding" of the Fourier spectrum around the Nyquist spatial frequency $\pi/a$, creating aliases 522 and 523 for the original harmonics 512 and 513, respectively. Supposing that the aperture has an evanescent cutoff given by $2\pi f/c$ as shown (where f is an operating frequency of the antenna and c is the speed of light in an ambient medium surrounding the antenna, which can be vacuum, air, a dielectric material, etc.), one of the harmonics (513) is aliased into the non-evanescent spatial frequency range (523) and can radiate as a grating lobe. Note that in this example, the first harmonic 511 is unaliased but also within the non-evanescent spatial frequency range, so it can generate another undesirable side lobe The Heaviside function is not the only choice for a binary hologram, and other choices may eliminate, average, or otherwise mitigate the higher harmonics and the resulting side/grating lobes. A useful way to view these approaches is as attempting to "smooth" or "blur" the sharp corners in the Heaviside without resorting to values other than 0 and 1. For example, the single step of the Heaviside function may be replaced by a function that resembles a pulse-width-modulated (PWM) square wave with a duty cycle that gradually increases from 0 to 1 over the range of the sinusoid. Alternatively, a probabilistic or dithering approach may be used to determine the settings of the individual scattering elements, for example by randomly adjusting each scattering element to the "on" or "off" state according to a probability that gradually increases from 0 to 1 over the range of the sinusoid.

In some approaches, the binary approximation of the hologram may be improved by increasing the density of scattering elements. An increased density results in a larger number of adjustable parameters that can be optimized, and a denser array results in better homogenization of electromagnetic parameters.

Alternatively or additionally, in some approaches the binary approximation of the hologram may be improved by arranging the elements in a non-uniform spatial pattern. If the scattering elements are placed on non-uniform grid, the rigid periodicity of the Heaviside modulation is broken, which spreads out the higher harmonics. The non-uniform spatial pattern can be a random distribution, e.g. with a selected standard deviation and mean, and/or it can be a gradient distribution, with a density of scattering elements that varies with position along the wave-propagating structure. For example, the density may be larger near the center of the aperture to realize an amplitude envelope.

Alternatively or additionally, in some approaches the binary approximation of the hologram may be improved by arranging the scattering elements to have non-uniform nearest neighbor couplings. Jittering these nearest-neighbor couplings can blur the k-harmonics, yielding reduced side/grating lobes. For example, in approaches that use a via fence to reduce coupling or crosstalk between adjacent unit cells, the geometry of the via fence (e.g. the spacing between vias, the sizes of the via holes, or the overall length of the fence) can be varied cell-by-cell. In other approaches that use a via fence to separate the cavities for a series of scattering elements that are cavity-fed slots, again the geometry of the via fence can be varied cell-by-cell. This variation can correspond to a random distribution, e.g. with a selected standard deviation and mean, and/or it can be a gradient distribution, with a nearest-neighbor coupling that varies with position along the wave-propagating structure. For example, the nearest-neighbor coupling may be largest (or smallest) near the center of the aperture.

Alternatively or additionally, in some approaches the binary approximation of the hologram may be improved by increasing the nearest-neighbor couplings between the scattering elements. For example, small parasitic elements can be introduced to act as "blurring pads" between the unit cells. The pad can be designed to have a smaller effect between two cells that are both "on" or both "off," and a larger effect between an "on" cell and an "off" cell, e.g. by radiating with an average of the two adjacent cells to realize a mid-point modulation amplitude.

Alternatively or additionally, in some approaches the binary approximation of the hologram may be improved using error propagation or error diffusion techniques to determine the modulation pattern. An error propagation technique may involve considering the desired value of a pure sinusoid modulation and tracking a cumulative difference between that and the Heaviside (or other discretization function). The error accumulates, and when it reaches a threshold it carries over to the current cell. For a two-dimensional scattering antenna composed of a set of rows, the error propagation may be performed independently on each row; or the error propagation may be performed row-by-row by carrying over an error tally from the end of row to the beginning of the next row; or the error propagation may be performed multiple times along different directions (e.g. first along the rows and then perpendicular to the rows); or the error propagation may use a two-dimensional error propagation kernel as with Floyd-Steinberg or Jarvis-Judice-Ninke error diffusion. For an embodiment using a plurality of one-dimensional waveguides to compose a two-dimensional aperture, the rows for error diffusion can correspond to individual one-dimensional waveguides, or the rows for error diffusion can be oriented perpendicularly to the one-dimensional waveguides. In other approaches, the rows can be defined with respect to the waveguide mode, e.g. by defining the rows as a series of successive phase fronts of the waveguide mode (thus, a center-fed parallel plate waveguide would have "rows" that are concentric circles around the feed point). In yet other approaches, the rows can be selected depending on the hologram function that is being discretized—for example, the rows can be selected as a series of contours of the hologram function, so that the error diffusion proceeds along directions of small variation of the hologram function.

Alternatively or additionally, in some approaches grating lobes can be reduced by using scattering elements with increased directivity. Often the grating lobes appear far from the main beam; if the individual scattering elements are designed to have increased broadside directivity, large-angle aliased grating lobes may be significantly reduced in amplitude.

Alternatively or additionally, in some approaches grating lobes can be reduced by changing the input wave $\Psi_{in}$ along the wave-propagating structure. By changing the input wave throughout a device, the spectral harmonics are varied, and large grating lobes may be avoided. For example, for a two-dimensional scattering antenna composed of a set of parallel one-dimensional rows, the input wave can be changed by alternating feeding directions for successive rows, or by alternating feeding directions for the top and bottom halves of the antenna. As another example, the effective index of propagation along the wave-propagating structure can be varied with position along the wave-propagating structure, by varying some aspect of the wave-propagating structure geometry (e.g. the positions of the vias in a substrate-integrated waveguide), by varying dielectric value (e.g. the filling fraction of a dielectric in a closed waveguide), by actively loading the wave-propagating structure, etc.

Alternatively or additionally, in some approaches the grating lobes can be reduced by introducing structure on top of the surface scattering antenna. For example, a fast-wave structure (such as a dispersive plasmonic or surface wave structure or an air-core-based waveguide structure) placed on top of the surface-scattering antenna can be designed to propagate the evanescent grating lobe and carry it out to a load dump before it aliases into the non-evanescent region. As another example, a directivity-enhancing structure (such as an array of collimating GRIN lenses) can be placed on top of the surface scattering antenna to enhance the individual directivities of the scattering elements.

While some approaches, as discussed above, arrange the scattering elements in a non-uniform spatial pattern, other approaches maintain a uniform arrangement of the scattering elements but vary their "virtual" locations to be used in calculating the modulation pattern. Thus the scattering elements can physically still exist on a uniform grid (or any other fixed physical pattern), but their virtual location is shifted in the computation algorithm. For example, the virtual locations can be determined by applying a random displacement to the physical locations, the random displacement having a zero mean and controllable distribution, analogous to classical dithering. Alternatively, the virtual locations can be calculated by adding a non-random displacement from the physical locations, the displacement varying with position along the wave-propagating structure (e.g. with intentional gradients over various length scales).

In some approaches, undesirable grating lobes can be reduced by flipping individual bits corresponding to individual scattering elements. In these approaches, each element can be described as a single bit which contributes spectrally to both the desired fundamental modulation and to the higher harmonics that give rise to grating lobes. Thus, single bits that contribute to harmonics more than the fundamental can be flipped, reducing the total harmonics level while leaving the fundamental relatively unaffected.

Alternatively or additionally, undesirable grating lobes can be reduced by applying a spectrum (in k-space) of modulation fundamentals rather than a single fundamental, i.e. range of modulation wavevectors, to disperse energy put into higher harmonics. This is a form of modulation dithering. Because higher harmonics pick up an additional a wave-vector phase when they alias back into the visible, grating lobes resulting from different modulation wavevectors can be spread in radiative angle even while the main beams overlap. This spectrum of modulation wavevectors can be flat, Gaussian, or any other distribution across a modulation wavevector bandwidth.

Alternatively or additionally, undesirable grating lobes can be reduced by "chopping" the range-discretized hologram (e.g. after applying the Heaviside function but before sampling at the discrete set of scattering element locations) to selectively reduce or eliminate higher harmonics. Selective elimination of square wave harmonics is described, for example, in H. S. Patel and R. G. Hoft, "Generalized Techniques of Harmonic Elimination and Voltage Control in Thyristor Inverters: Part I—Harmonic Elimination," IEEE Trans. Ind. App. Vol. IA-9, 310 (1973), herein incorporated by reference. For example, the square wave 502 of FIG. 5B can be modified with "chops" that eliminate the harmonics 511 and 513 (as shown in FIG. 5E) so that neither the harmonic 511 nor the aliased harmonic 531 (as shown in FIG. 5F) will generate grating lobes.

Alternatively or additionally, undesirable grating lobes may be reduced by adjusting the wavevector of the modulation pattern. Adjusting the wavevector of the modulation pattern shifts the primary beam, but shifts grating lobes coming from aliased beams to a greater degree (due to the additional 27*c* phase shift on every alias). Adjustment of the phase and wavevector of the applied modulation pattern can be used to intentionally form constructive and destructive interference of the grating lobes, side lobes, and main beam. Thus, allowing very minor changes in the angle and phase of the main radiated beam can grant a large parameter space in which to optimize/minimize grating lobes.

Alternatively or additionally, the antenna modulation pattern can be selected according to an optimization algorithm that optimizes a particular cost function. For example, the modulation pattern may be calculated to optimize: realized gain (maximum total intensity in the main beam); relative minimization of the highest side lobe or grating lobe relative to main beam; minimization of main-beam FWHM (beam width); or maximization of main-beam directivity (height above all integrated side lobes and grating lobes); or any combination thereof (e.g. by using a collective cost function that is a weighted sum of individual cost functions, or by selecting a Pareto optimum of individual cost functions). The optimization can be either global (searching the entire space of antenna configurations to optimize the cost function) or local (starting from an initial guess and applying an optimization algorithm to find a local extremum of the cost function).

Various optimization algorithms may be utilized to perform the optimization of the desired cost function. For example, the optimization may proceed using discrete optimization variables corresponding to the discrete adjustment states of the scattering elements, or the optimization may proceed using continuous optimization variables that can be mapped to the discrete adjustment states by a smoothed step function (e.g. a smoothed Heaviside function for a binary antenna or a smoothed sequential stair-step function for a grayscale antenna). Other optimization approaches can include optimization with a genetic optimization algorithm or a simulated annealing optimization algorithm.

The optimization algorithm can involve an iterative process that includes identifying a trial antenna configuration, calculating a gradient of the cost function for the antenna configuration, and then selecting a subsequent trial configuration, repeating the process until some termination condition is met. The gradient can be calculated by, for example, calculating finite-difference estimates of the partial derivatives of the cost function with respect to the individual optimization variables. For N scattering elements, this might involve performing N full-wave simulations, or performing N measurements of a test antenna in a test environment (e.g. an anechoic chamber). Alternatively, the gradient may be calculable by an adjoint sensitivity method that entails solving a single adjoint problem instead of N finite-difference problems; adjoint sensitivity models are available in conventional numerical software packages such as HFSS or CST Microwave Studio. Once the gradient is obtained, a subsequent trial configuration can be calculated using various optimization iteration approaches such as quasi-Newton methods or conjugate gradient methods. The iterative process may terminate, for example, when the norm of the cost function gradient becomes sufficiently small, or when the cost function reaches a satisfactory minimum (or maximum).

In some approaches, the optimization can be performed on a reduced set of modulation patterns. For example, for a binary (grayscale) antenna with N scattering elements, there are $2^N$ (or $g^N$, for g grayscale levels) possible modulation patterns, but the optimization may be constrained to consider only those modulation patterns that yield a desired primary spectral content in the output wave $\Psi_{out}$, and/or the optimization may be constrained to consider only those modulation patterns which have a spatial on-off fraction within a known range relevant for the design.

While the above discussion of modulation patterns has focused on binary embodiments of the surface scattering antenna, it will be appreciated that all of the various approaches described above are directly applicable to grayscale approaches where the individual scattering elements are adjustable between more than two configurations.

Figure 6:
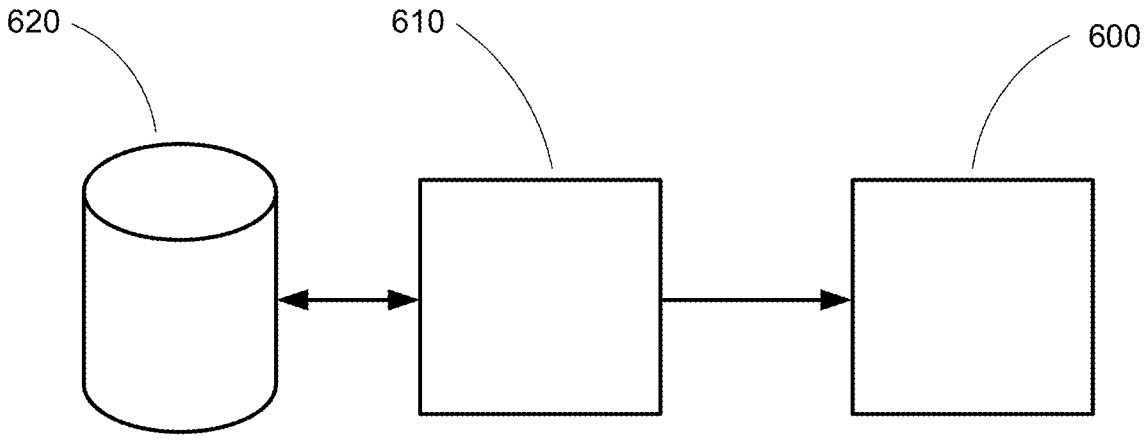
FIG. 6 depicts a system block diagram.

With reference now to FIG. 6, an illustrative embodiment is depicted as a system block diagram. The system includes a surface scattering antenna 600 coupled to control circuitry 610 operable to adjust the surface scattering to any particular antenna configuration. The system optionally includes a storage medium 620 on which is written a set of pre-calculated antenna configurations. For example, the storage medium may include a look-up table of antenna configurations indexed by some relevant operational parameter of the antenna, such as beam direction, each stored antenna configuration being previously calculated according to one or more of the approaches described above. Then, the control circuitry 610 would be operable to read an antenna configuration from the storage medium and adjust the antenna to the selected, previously-calculated antenna configuration. Alternatively, the control circuitry 610 may include circuitry operable to calculate an antenna configuration according to one or more of the approaches described above, and then to adjust the antenna for the presently-calculated antenna configuration.

Figure 7:
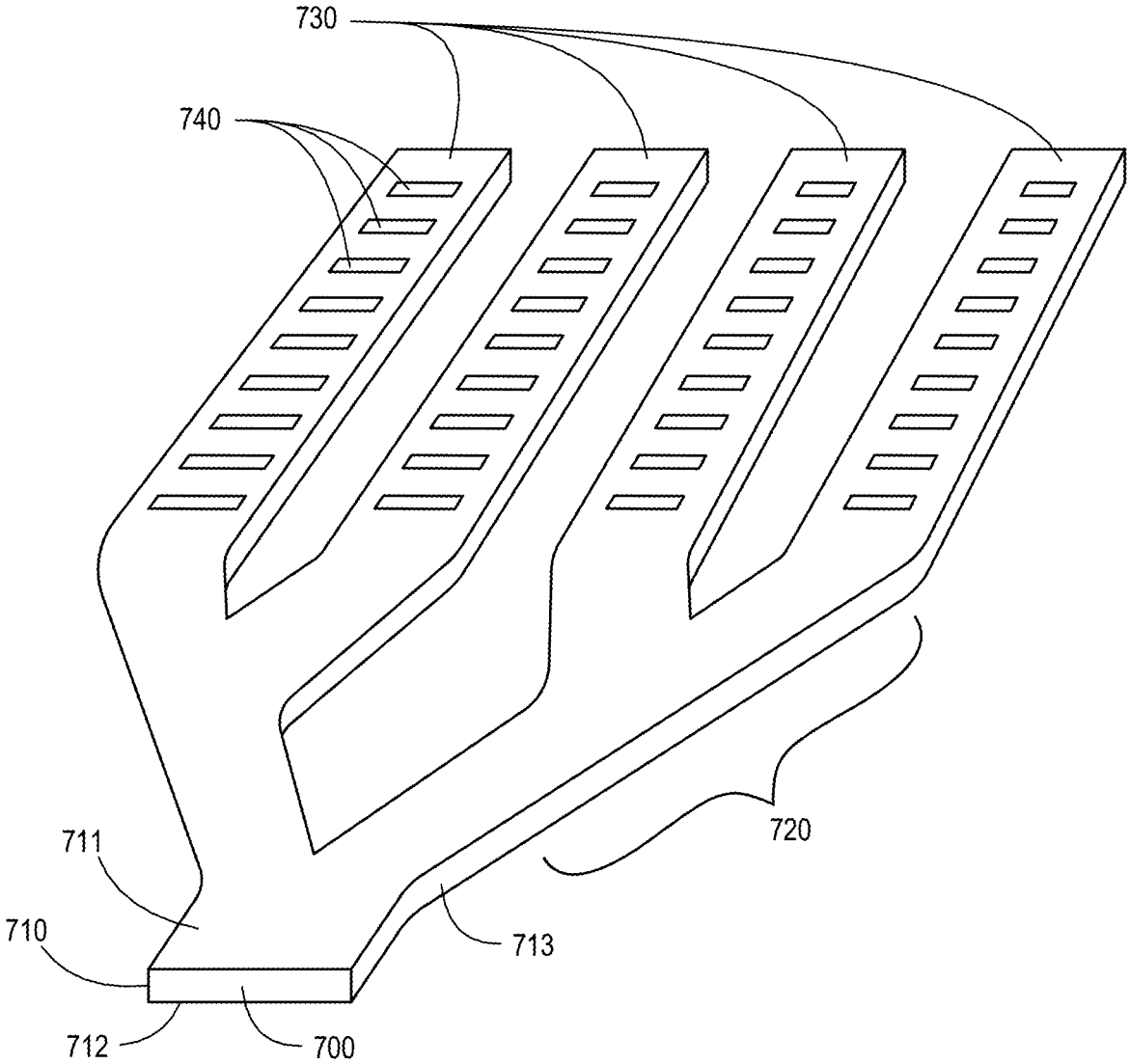
FIG. 7 depicts an exemplary substrate-integrated waveguide.

FIG. 7 depicts an exemplary closed waveguide implemented as a substrate-integrated waveguide. A substrate-integrated waveguide typically includes a dielectric substrate 710 defining an interior of the waveguide, a first conducting surface 711 above the substrate defining a "ceiling" of the waveguide, a second conducting surface 712 defining a "floor" of the waveguide, and one or more colonnades of vias 713 between the first conducting surface and the second conducting surface defining the walls of the waveguide. Substrate-integrated waveguides are amenable to fabrication by standard printed-circuit board (PCB) processes. For example, a substrate-integrated waveguide may be implemented using an epoxy laminate material (such as FR-4) or a hydrocarbon/ceramic laminate (such as Rogers 4000 series) with copper cladding on the upper and lower surfaces of the laminate. A multi-layer PCB process may then be employed to situate the scattering elements above the substrate-integrated waveguide, and/or to place control circuitry below the substrate-integrated waveguide, as further discussed below. Substrate-integrated waveguides are also amenable to fabrication by very-large scale integration (VLSI) processes. For example, for a VLSI process providing multiple metal and dielectric layers, the substrate-integrated waveguide can be implemented with a lower metal layer as the floor of the waveguide, one or more dielectric layers as the interior of the waveguide, and a higher metal layer as the ceiling of the waveguide, with a series of masks defining the footprint of the waveguide and the arrangement of inter-layer vias for the waveguide walls.

In the example of FIG. 7, the substrate-integrated waveguide includes a plurality of parallel one-dimensional waveguides 730. To distribute a guided wave to this plurality of waveguide "fingers," the substrate-integrate waveguide includes a power divider section 720 that distributes energy delivered at the input port 700 to the plurality of fingers 730. As shown in this example, the power divider 720 may be implemented as a tree-like structure, e.g. a binary tree. Each of the parallel one-dimensional waveguides 730 supports a set of scattering elements arranged along the length of the waveguide, so that the entire set of scattering elements can fill a two-dimensional antenna aperture, as discussed previously. The scattering elements may be coupled to the guided wave that propagates within the substrate-integrated waveguide by an arrangement of apertures or irises 740 on the upper conducting surface of the waveguides. These irises 740 are depicted as rectangular slots in FIG. 7, but this is not intended to be limiting, and other iris geometrics may include squares, circles, ellipses, crosses, etc. Some approaches may use multiple sub-irises per unit cell, e.g. a set of parallel thin slits aligned perpendicular to the length of the waveguide.

Turning now to a consideration of the scattering elements that are coupled to the waveguide, FIGS. 8A-8D depict schematic configurations of scattering elements that are adjustable using lumped elements. Throughout this disclosure, the term "lumped element" shall be generally understood to include discrete or packaged electronic components. These can include two-terminal lumped elements such as packaged resistors, capacitors, inductors, diodes, etc.; three-terminal lumped elements such as transistors and three-port tunable capacitors; and lumped elements with more than three terminals, such as op-amps. Lumped elements shall also be understood to include packaged integrated circuits, e.g. a tank (LC) circuit integrated in a single package.

Figure 8A:
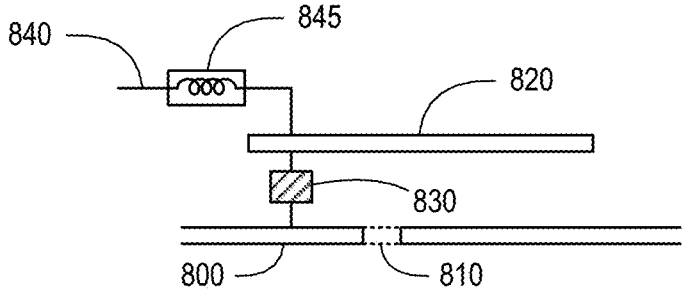
FIGS. 8A-8D depict schematic configurations of scattering elements that are adjustable using lumped elements.

In the configuration of FIG. 8A, the scattering element is generically depicted as a conductor 820 positioned above an aperture 810 in a ground body 800. For example, the scattering element may be a patch antenna element, in which case the conductor 820 is a conductive patch and the aperture 810 is an iris that couples the patch antenna element to a guided wave that propagates under the ground body 800 (e.g., where the ground body 800 is the upper conductor of a waveguide such as the substrate-integrated waveguide of FIG. 5). Although this disclosure describes various embodiments that include substantially rectangular conductive patches, this is not intended to be limiting; other conductive patch shapes are contemplated, including bowties, microstrip coils, patches with various slots including interior slots, circular/elliptical/polygonal patches, etc. Moreover, although this disclosure describes various embodiments that include patches situated on a plane above a ground body, this is again not intended to be limiting; other arrangements are contemplated, including, for example: (1) CELC structures, wherein the conducting patch is situated within the aperture 810 and coplanar with the ground body 800; (2) patches that are evanescently coupled to, and coplanar with, a coplanar waveguide; and (3) multiple sub-patch arrangements including multi-layer arrangements with sub-patches situated on two or more planes above the ground body.

The scattering element of FIG. 8A is made adjustable by connecting a two port lumped element 830 between the conductor 820 and the ground body 800. If the two-port lumped element is nonlinear, a shunt resistance or reactance between the conductor and the ground body can be controlled by adjusting a bias voltage delivered by a bias control line 840. For example, the two-port lumped element can be a varactor diode whose capacitance varies as a function of the applied bias voltage. As another example, the two-port lumped element can be a PIN diode that functions as an RF or microwave switch that is open when reverse biased and closed when forward biased.

In some approaches, the bias control line 840 includes an RF or microwave choke 845 designed to isolate the low frequency bias control signal from the high frequency RF or microwave resonance of the scattering element. The choke can be implemented as another lumped element such as an inductor (as shown). In other approaches, the bias control line may be rendered RF/microwave neutral by means of its length or by the addition of a tuning stub. In yet other approaches, the bias control line may be rendered RF/microwave neutral by using a low-conductivity material for the bias control line; examples of low-conductivity materials include indium tin oxide (ITO), polymer-based conductors, a granular graphitic materials, and percolated metal nanowire network materials. In yet other approaches, the bias control line may be rendered RF/microwave neutral by positioning the control line on a node or symmetry axis of the scattering element's radiation mode, e.g. as shown for scattering elements 902 and 903 of FIG. 9A, as discussed below. These various approaches may be combined to further improve the RF/microwave isolation of the bias control line.

While FIG. 8A depicts only a single two-port lumped element 830 connected between the conductor 820 and the ground body 800, other approaches include additional lumped elements that may be connected in series with or parallel to the lumped element 830. For example, multiple iterations of the two-port lumped element 830 may be connected in parallel between the conductor 820 and the ground body 800, e.g. to distribute dissipated power between several lumped elements and/or to arrange the lumped elements symmetrically with respect to the radiation pattern of the resonator (as further discussed below). Alternatively or additionally, passive lumped elements such as inductors and capacitors may be added as additional loads on the patch antenna, thus altering the natural or un-loaded response of the patch antenna. This admits flexibility, for example, in the physical size of the patch in relation to its resonant frequency (as further discussed below in the context of FIGS. 10A-10E). Alternatively or additionally, passive lumped elements may be introduced to cancel, offset, or modify a parasitic package impedance of the active lumped element 830. For example, an inductor or capacitor may be added to cancel a package capacitance or impedance, respectively, of the active lumped element 830 at the resonant frequency of the patch antenna. It is also contemplated that these multiple components per unit cell could be completely integrated into a single packaged integrated circuit, or partially integrated into a set of packaged integrated circuits.

Figure 8B:
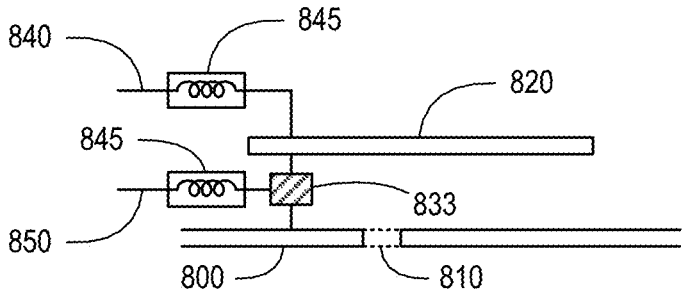

Turning now to FIG. 8B, the scattering element is again generically depicted as a conductor 820 positioned above an aperture 810 in a ground body 800. The scattering element of FIG. 8B is made adjustable by connecting a three-port lumped element 833 between the conductor 820 and the ground body 800, i.e. by connecting a first terminal of the three-port lumped element to the conductor 820 and a second terminal to the ground body 800. Then a shunt resistance or reactance between the conductor 820 and the ground body 800 can be controlled by adjusting a bias voltage on a third terminal of the three-port lumped element 833 (delivered by a bias control line 850) and, optionally, by also adjusting a bias voltage on the conductor 800 (delivered by an optional bias control line 840). For example, the three-port lumped element can be a field-effect transistor (such as a high-electron-mobility transistor (HEMT)) having a source (drain) connected to the conductor 820 and a drain (source) connected to the ground body 800; then the drain-source voltage can be controlled by the bias control line 840 and the gate-drain (gate-source) voltage can be controlled by the bias control line 850. As another example, the three-port lumped element can be a bipolar junction transistor (such as a heterojunction bipolar transistor (HBT)) having a collector (emitter) connected to the conductor 820 and an emitter (collector) connected to the ground body 800; then the emitter-collector voltage can be controlled by the bias control line 840 and the base-emitter (base-collector) voltage can be controlled by the bias control line 850. As yet another example, the three-port lumped element can be a tunable integrated capacitor (such as a tunable BST RF capacitor) having first and second RF terminals connected to the conductor 820 and the ground body 800; then the shunt capacitance can be controlled by the bias control line 850.

As in FIG. 8A, various approaches can be used to isolate the bias control lines 840 and 850 of FIG. 8B so that they do not perturb the RF or microwave resonance of the scattering element. Thus, as similarly discussed above in the context of FIG. 8A, the bias control lines may include RF/microwave chokes or tuning stubs, and/or they may be made of a low-conductivity material, and/or they may be brought into the unit cell along a node or symmetry axis of the unit cell's radiation mode. Note that the bias control line 850 may not need to be isolated if the third port of the three port lumped element 833 is intrinsically RF/microwave neutral.

While FIG. 8B depicts only a single three-port lumped element 833 connected between the conductor 820 and the ground body 800, other approach include additional lumped elements that may be connected in series with or parallel to the lumped element 830. Thus, as similarly discussed above in the context of FIG. 8A, multiple iterations of the three-port lumped element 833 may be connected in parallel; and/or the passive lumped elements may be added for patch loading or package parasitic offset; and/or these multiple elements may be integrated into a single packaged integrated circuit or a set of packaged integrated circuits.

Figure 8C:
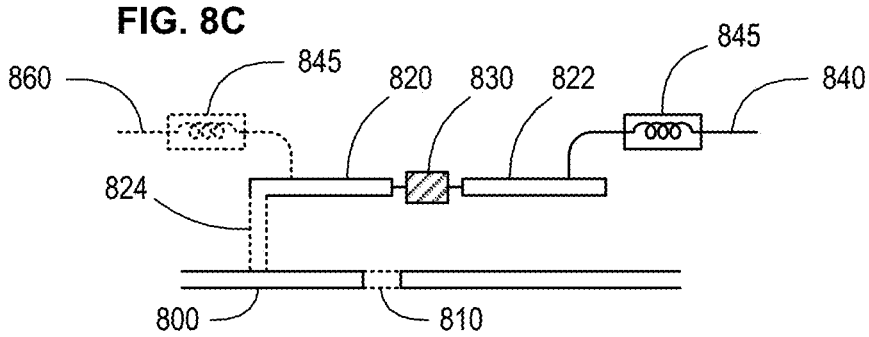
Figure 8D:
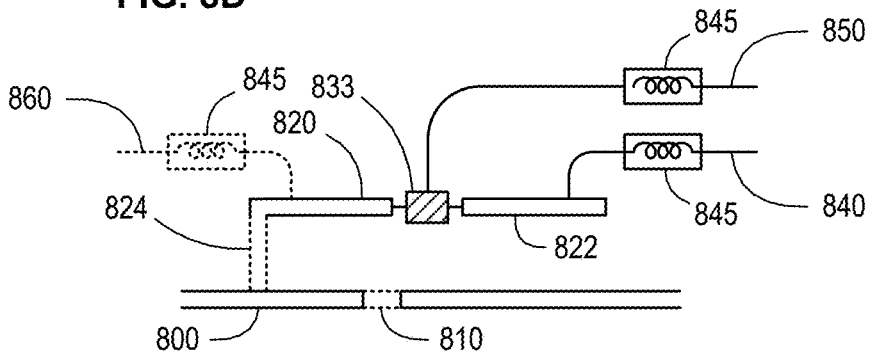

In some approaches, e.g. as depicted in FIGS. 8A and 8B, the scattering element comprises a single conductor 820 above a ground body 800. In other approaches, e.g. as depicted in FIGS. 8C and 8D, the scattering element comprises a plurality of conductors above a ground body. Thus, in FIGS. 8C and 8D, the scattering element is generically depicted as a first conductor 820 and a second conductor 822 positioned above an aperture 810 in a ground body 800. For example, the scattering element may be a multiple-patch antenna having a plurality of subpatches, in which case the conductors 820 and 822 are first and second sub-patches and the aperture 810 is an iris that couples the multiple-patch antenna to a guided wave that propagates under the ground body 800 (e.g., where the ground body 800 is the upper conductor of a waveguide such as the substrate-integrated waveguide of FIG. 5). One or more of the plurality of sub-patches may be shorted to the ground body, e.g. by an optional short 824 between the first conductor 820 and the ground body 800. This can have the effect of "folding" the patch antenna to reduce the size of the patch antenna in relation to its resonant wavelength, yielding a so-called aperture-fed "PIFA" (Planar Inverted-F Antenna).

With reference now to FIG. 8C, just as the two-port lumped element 830 provides an adjustable shunt impedance in FIG. 8A by virtue of its connection between the conductor 820 and the ground body 800, a two-port lumped element 830 provides an adjustable series impedance in FIG. 8C by virtue of its connection between the first conductor 820 and the second conductor 822. In one approach shown in FIG. 8C, the first conductor 820 is shorted to the ground body 800 by a short 824, and a voltage difference is applied across the two-port lumped element with a bias voltage line 840. In an alternative approach shown in FIG. 8C, the short 824 is absent and a voltage difference is applied across the two-port lumped element 830 with two bias voltage lines 840 and 860.

Noting that a two-port lumped element is depicted in both FIG. 8A and in FIG. 8C, various embodiments contemplated for the shunt scenario of FIG. 8A are also contemplated for the series scenario of FIG. 8C, namely: (1) the two-port lumped elements contemplated above in the context of FIG. 8A as shunt lumped elements are also contemplated in the context of FIG. 8C as series lumped elements; (2) the bias control line isolation approaches contemplated above in the context of FIG. 8A are also contemplated in the context of FIG. 8C; and (3) further lumped elements (connected in series or in parallel with the two-port lumped element 830) contemplated above in the context of FIG. 8A are also contemplated in the context of FIG. 8C.

With reference now to FIG. 8D, just as the three-port lumped element 833 provides an adjustable shunt impedance in FIG. 8B by virtue of its connection between the conductor 820 and the ground body 800, a three-port lumped element 833 provides an adjustable series impedance in FIG. 8D by virtue of its connection between the first conductor 820 and the second conductor 822. A bias voltage is applied to a third terminal of the three-port lumped element with a bias voltage line 850. In one approach shown in FIG. 8D, the first conductor 820 is shorted to the ground body 800 by a short 824, and a voltage difference is applied across first and second terminals of the three-port lumped element with a bias voltage line 840. In an alternative approach shown in FIG. 8D, the short 824 is absent and a voltage difference is applied across first and second terminals of the three-port lumped element with two bias voltage lines 840 and 860.

Noting that a three-port lumped element is depicted in both FIG. 8B and in FIG. 8D, various embodiments contemplated for the shunt scenario of FIG. 8B are also contemplated for the series scenario of FIG. 8D, namely: (1) the three-port lumped elements contemplated above in the context of FIG. 8B as shunt lumped elements are also contemplated in the context of FIG. 8D as series lumped elements; (2) the bias control line isolation approaches contemplated above in the context of FIG. 8B are also contemplated in the context of FIG. 8D; and (3) further lumped elements (connected in series or in parallel with the three-port lumped element 833) contemplated above in the context of FIG. 8B are also contemplated in the context of FIG. 8D.

Finally, it is to be appreciated that some approaches may combine both shunt lumped elements and series lumped elements. Thus, embodiments of a scattering element may include one or more of the shunt arrangements contemplated above with respect to FIGS. 8A and 8B in combination with one or more of the series arrangements contemplated above with respect to FIGS. 8C and 8D.

FIGS. 9A-9D depict a variety of exemplary physical layouts corresponding to the schematic lumped element arrangements of FIGS. 8A-8D, respectively. The figures depict top views of an individual unit cell or scattering element, and the numbered figure elements depicted in FIGS. 8A-8D are numbered in the same way when they appear in FIGS. 9A-9D.

Figure 9A:
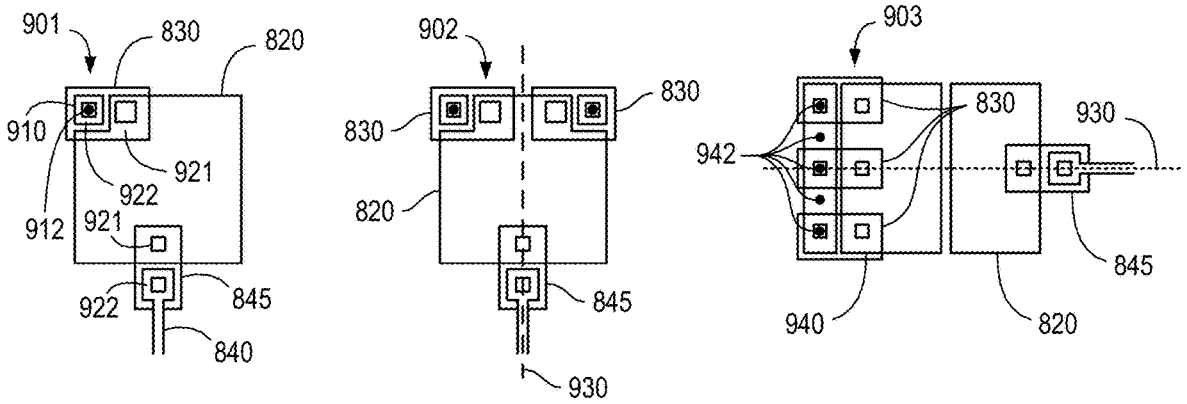
FIGS. 9A-9D depict exemplary physical layouts corresponding to the schematic lumped element arrangements of FIGS. 8A-8D, respectively.

In the exemplary scattering element 901 of FIG. 9A, the conductor 820 is depicted as a rectangle with a notch removed from the comer. The notch admits the placement of a small metal region 910 with a via 912 connecting the metal region 910 to the ground body 800 on an underlying layer (not shown). The purpose of this via structure (metal region 910 and via 912) is to allow for a surface mounting of the lumped element 830, so that the two-port lumped element 830 can be implemented as a surface-mounted component with a first contact 921 that connects the lumped element to the conductor 820 and a second contact 922 that connects to the underlying ground body 800 by way of the via structure 910-912. The bias control line 840 is connected to the conductor 820 through a surface-mounted RF/microwave choke 845 having two contacts 921 and 922 that connect the choke to the conductor 820 and the bias control line 840, respectively.

The exemplary scattering element 902 of FIG. 9A illustrates the concept of deploying multiple iterations of the two-port lumped element 930. Scattering element 902 includes two lumped elements 830 placed on two adjacent comers of the rectangular conductor 820. In addition to reducing the current load on each iteration of the lumped element 930, e.g. to reduce nonlinearity effects or to distribute power dissipation, the multiple lumped elements can be arranged to preserve a geometrical symmetry of the unit cell and/or to preserve a symmetry of the radiation mode of the unit cell. In this example, the two lumped elements 830 are arranged symmetrically with respect to a plane of symmetry 930 of the unit cell. The choke 845 and bias line 840 are also arranged symmetrically with respect to the plane of symmetry 930, because they are positioned on the plane of symmetry. In some approaches, the symmetrically arranged elements 830 are identical lumped elements. In other approaches, the symmetrically arranged elements are non-identical (e.g. one is an active element and the other is a passive element); this may disturb the unit cell symmetry but to a much smaller extent than the solitary lumped element of scattering element 901.

The exemplary scattering element 903 of FIG. 9A illustrates another physical layout consistent with the schematic arrangement of FIG. 8A. In scattering element 903, instead of using a pin-like via structure as in 901 (with a small pinhead 910 capping a single via 912), the element uses an extended wall-like via structure (with a metal strip 940 capping a wall-like colonnade of vias 942). The wall can extend along an entire edge of the rectangular patch 820, as shown, or it can extend along only a portion of the edge. As in 902, the scattering element includes multiple iterations of the two-port lumped element 830, and these iterations are arranged symmetrically with respect to a plane of symmetry 930, as is the choke 845.

Figure 9B:
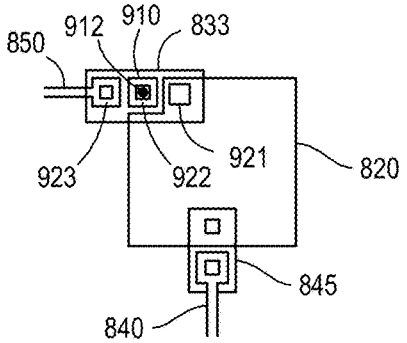

With reference now to FIG. 9B, the figure depicts an exemplary physical layout corresponding to the schematic three-port lumped element shunt arrangement of FIG. 8B. The conductor 820 is depicted as a rectangle with a notch removed from the comer. The notch admits the placement of a small metal region 910 with a via 912 connecting the metal region 910 to the ground body 800 on an underlying layer (not shown). The purpose of this via structure (metal region 910 and via 912) is to allow for a surface mounting of the lumped element 833, so that the three-port lumped element 830 can be implemented as a surface-mounted component with a first contact 921 that connects the lumped element to the conductor 820, a second contact 922 that connects the lumped element to the underlying ground body 800 by way of the via structure 910-912, and a third contact 923 that connects the lumped element to the bias voltage line 850. The optional second bias control line 840 is connected to the conductor 820 through a surface-mounted RF/microwave choke 845 having two contacts 921 and 922 that connect the choke to the conductor 820 and the bias control line 840, respectively. It will be appreciated that multiple three-port elements can be arranged symmetrically in a manner similar to that of scattering element 902 of FIG. 9A, and that the pin-like via structure 910-912 can be replaced with a wall-like via structure in a manner similar to that of scattering element 903 of FIG. 9A.

Figure 9C:
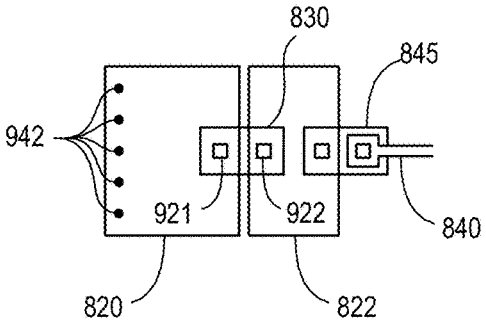

With reference now to FIG. 9C, the figure depicts an exemplary physical layout corresponding to the schematic two-port lumped element series arrangement of FIG. 8C. The short 824 is a wall-like short implemented as a colonnade of vias 942. The two-port lumped element is a surface-mounted component 830 that spans the gap between the first conductor 820 and the second conductor 822, having a first contact 921 that connects the lumped element to the first conductor 820 and a second contact 922 that connects the lumped element to the second conductor 822. The bias control line 840 is connected to the second conductor 822 through a surface-mounted RF/microwave choke 845 having two contacts 921 and 922 that connect the choke to the second conductor 822 and the bias control line 840, respectively. It will again be appreciated that multiple lumped elements can be arranged symmetrically in a manner similar to the arrangements depicted for scattering elements 902 and 903 of FIG. 9A.

Figure 9D:
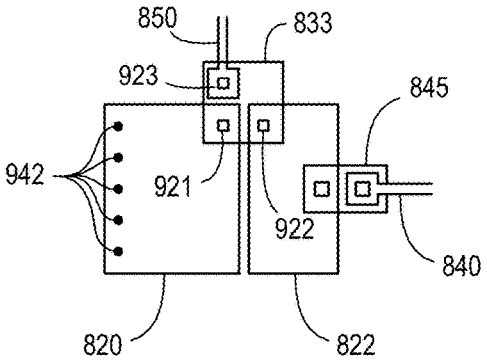

Finally, with reference to FIG. 9D, the figure depicts an exemplary physical layout corresponding to the schematic three-port lumped element series arrangement of FIG. 8D. The short 824 is a wall-like short implemented as a colonnade of vias 942. The three-port lumped element is a surface-mounted component 833 that spans the gap between the first conductor 820 and the second conductor 822, having a first contact 921 that connects the lumped element to the first conductor 820, a second contact 922 that connects the lumped element to the second conductor 822, and a third contact 923 that connects the lumped element to the bias voltage line 850. The optional second bias control line 840 is connected to the second conductor 822 through a surface-mounted RF/microwave choke 845 having two contacts 921 and 922 that connect the choke to the second conductor 822 and the bias control line 840, respectively. It will again be appreciated that multiple lumped elements can be arranged symmetrically in a manner similar to the arrangements depicted for scattering elements 902 and 903 of FIG. 9A.

Figure 10A:
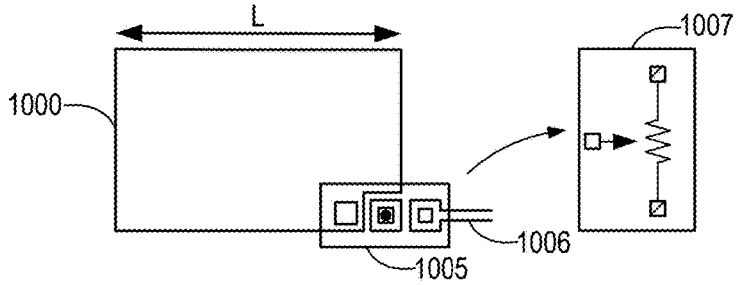
FIGS. 10A-10E depict exemplary physical layouts of patches with lumped elements.
Figure 10B:
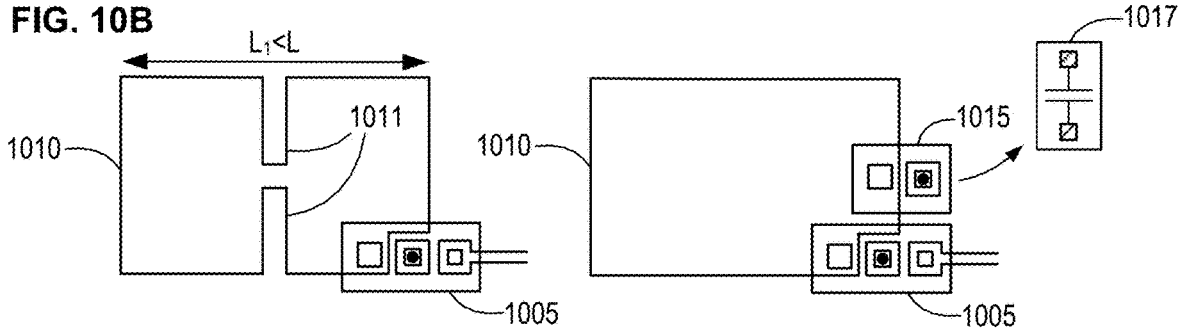
Figure 10C:
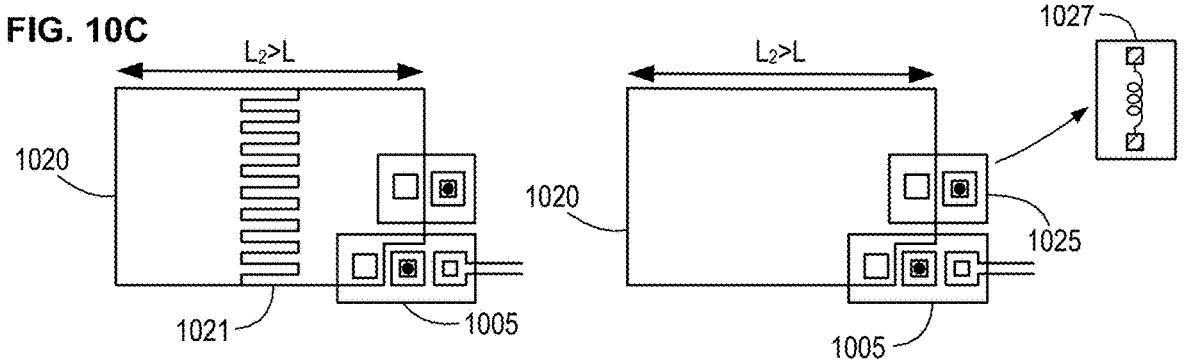
Figure 10D:
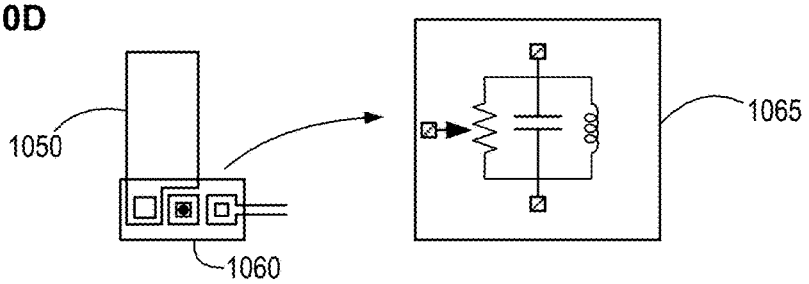
Figure 10E:
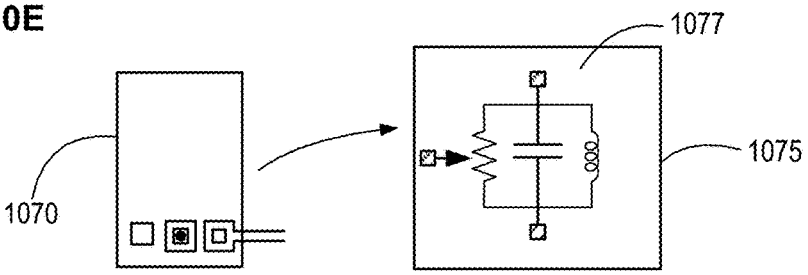

With reference now to FIGS. 10A-10E, the figures depict various examples showing how the addition of lumped elements can admit flexibility regarding the physical geometry of the patch in relation to its resonant frequency (FIGS. 10D-E also show how the lumped elements can integrate multiple components in a single package). Starting with a rectangular patch 1000 of length L in FIG. 10A, the patch can be shortened without altering its resonant frequency by loading the shortened patch 1010 with a series inductance or shunt capacitance (FIG. 10B), or the patch can be lengthened without altering its resonant frequency by loading the lengthened patch 1020 with a series capacitance or a shunt inductance (FIG. SC). The patch can be loaded with a series inductance by, for example, adding notches 1011 to the patch to create an inductive bottleneck as shown in FIG. 10B, or by spanning two sub-patches with a lumped element inductor (as with the lumped element 830 in FIG. 9C). The patch can be loaded with a shunt capacitance by, for example, adding a lumped element capacitor 1015 (with a schematic pinout 1017) as shown in FIG. 10B with a via that drops down to a ground plane (as with the lumped element 830 in FIG. 9A). The patch can be loaded with a series capacitance by, for example, interdigitating two sub-patches to create an interdigitated capacitor 1021 as shown in FIG. 10C, and/or by spanning two sub-patches with a lumped element capacitor (as with the lumped element 830 in FIG. 9C). And the patch can be loaded with a shunt inductance by, for example, adding a lumped element inductor 1025 (with a schematic pinout 1027) as shown in FIG. 10C with a via that drops down to a ground plane (as with the lumped element 830 in FIG. 9A). In each of these examples of FIGS. 10A-8C, the patch is rendered tunable by the addition of an adjustable three-port shunt lumped element 1005 addressed by a bias voltage line 1006 (as with the three-port lumped element 833 in FIG. 9B). The three-port adjustable lumped element 1005 has a schematic pinout 1007 that depicts the adjustable element as an adjustable resistive element, but an adjustable reactive (capacitive or inductive) element could be substituted.

Recognizing the flexibility regarding the physical geometry of the patch when loaded with lumped elements, FIG. 10D depicts a scattering element in which the resonance behavior is principally determined not by the geometry of a metallic radiator 1050, but by the LC resonance of an adjustable tank circuit lumped element 1060. In this scenario, the radiator 1050 may be substantially smaller than an unloaded patch with the same resonance behavior. The three-port lumped element 1060 is a packaged integrated circuit with a schematic pinout 1065, here depicted as an RLC circuit with an adjustable resistive element (again, an adjustable reactive (capacitive or inductive) element could be substituted). It is to be noted that the resistance, inductance, and/or capacitance of the lumped element can substantially include, or even be constituted of, parasitics attributable to the lumped element packaging.

In some approaches, the radiative element may itself be integrated with the adjustable tank circuit, so that the entire scattering element is packaged as a lumped element 1070 as shown in FIG. 10E. The schematic pinout 1075 of this completely integrated scattering element is depicted as an adjustable RLC circuit coupled to an on-chip radiator 1077. Again, the resistance, inductance, and/or capacitance of the lumped element can substantially include, or even be constituted of, parasitics attributable to the lumped element packaging.

Figure 11A:
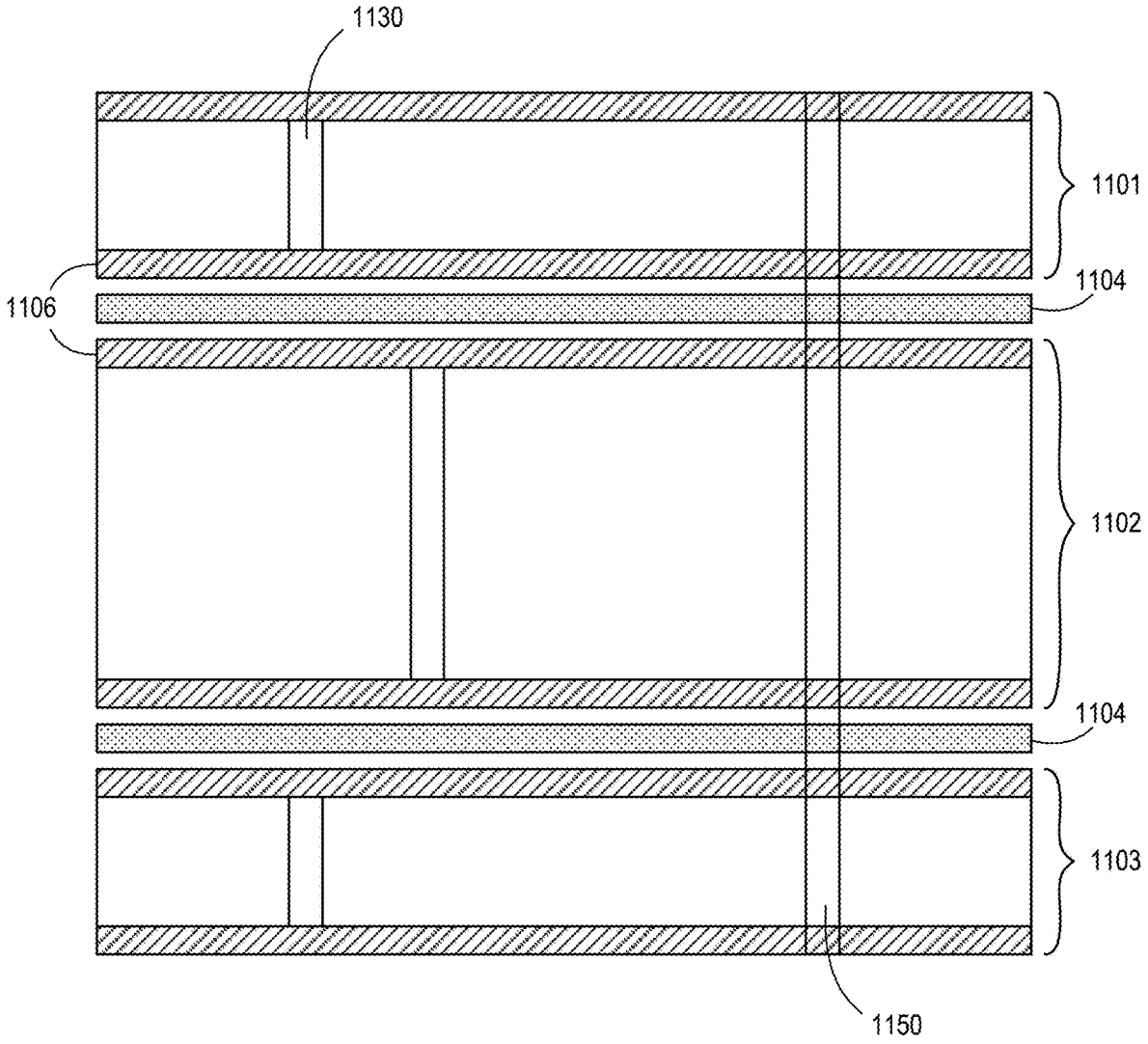
FIGS. 11A-11B depict a first illustrative embodiment of a surface scattering antenna with lumped elements.
Figure 11B:
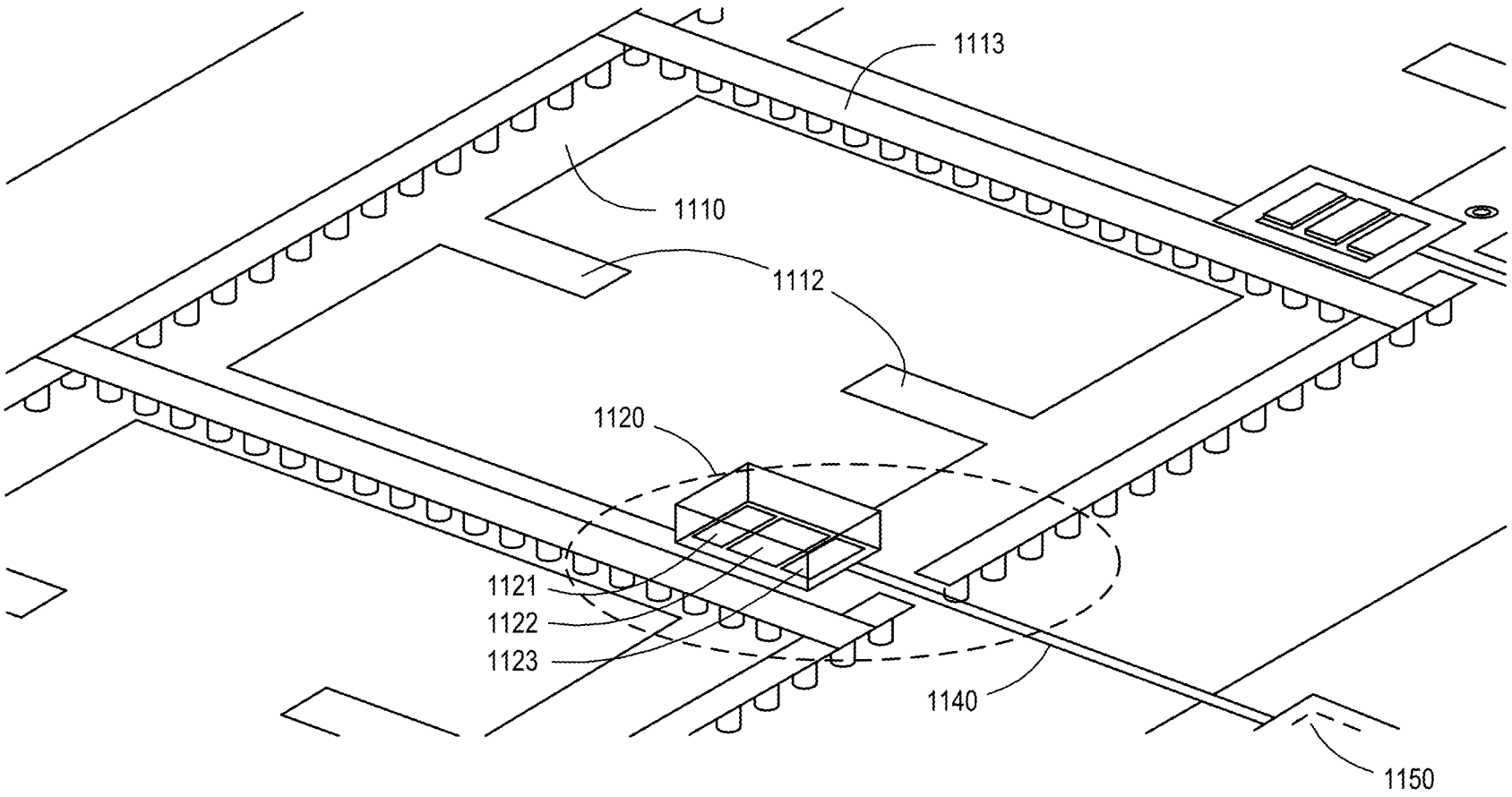

With reference now to FIGS. 11A-11B, a first illustrative embodiment of a surface scattering antenna is depicted. As shown in the side view of FIG. 11A, the illustrative embodiment is a multi-layer PCB assembly including a first double-cladded core 1101 implementing the scattering elements, a second double-cladded core 1102 implementing a substrate-integrated waveguide such as that depicted in FIG. 7, and a third double-cladded core 1103 supporting the bias circuitry for the scattering elements. The multiple cores are joined by layers of prepreg 1104. As shown in the top perspective view of FIG. 11B, the scattering elements are implemented as patches 1110 positioned above irises (not shown) in the upper conductor 1106 of the underlying substrate-integrated waveguide (notice that for ease of fabrication, in this embodiment the upper waveguide conductor 1106 is actually a pair of adjacent copper claddings). In this example, each patch 1110 includes notches that inductively load the patch. Moreover, each patch is seen to include a via cage 1113, i.e.

a colonnade of vias that surrounds the unit cell to reduce coupling or crosstalk between adjacent unit cells.

In this illustrative embodiment, each patch 1110 includes a three-port lumped element (such as a HEMT) implemented as a surface-mounted component 1120. The configuration is similar to that of FIG. 9B as discussed above: a first contact 1121 connects the lumped element to the patch 1110; a second contact 1122 connects the lumped element to pin-like structure that drops a via (element 1130 in the side view of FIG. 11A) down to the waveguide conductor 1106; and a third contact 1123 connects the lumped element to a bias voltage line 1140. The bias voltage line 1140 extends beyond the transverse extent of the substrate-integrated via and is then connected by a through-via 1150 to bias control circuitry on the opposite side of the multi-layer assembly.

Figure 12:
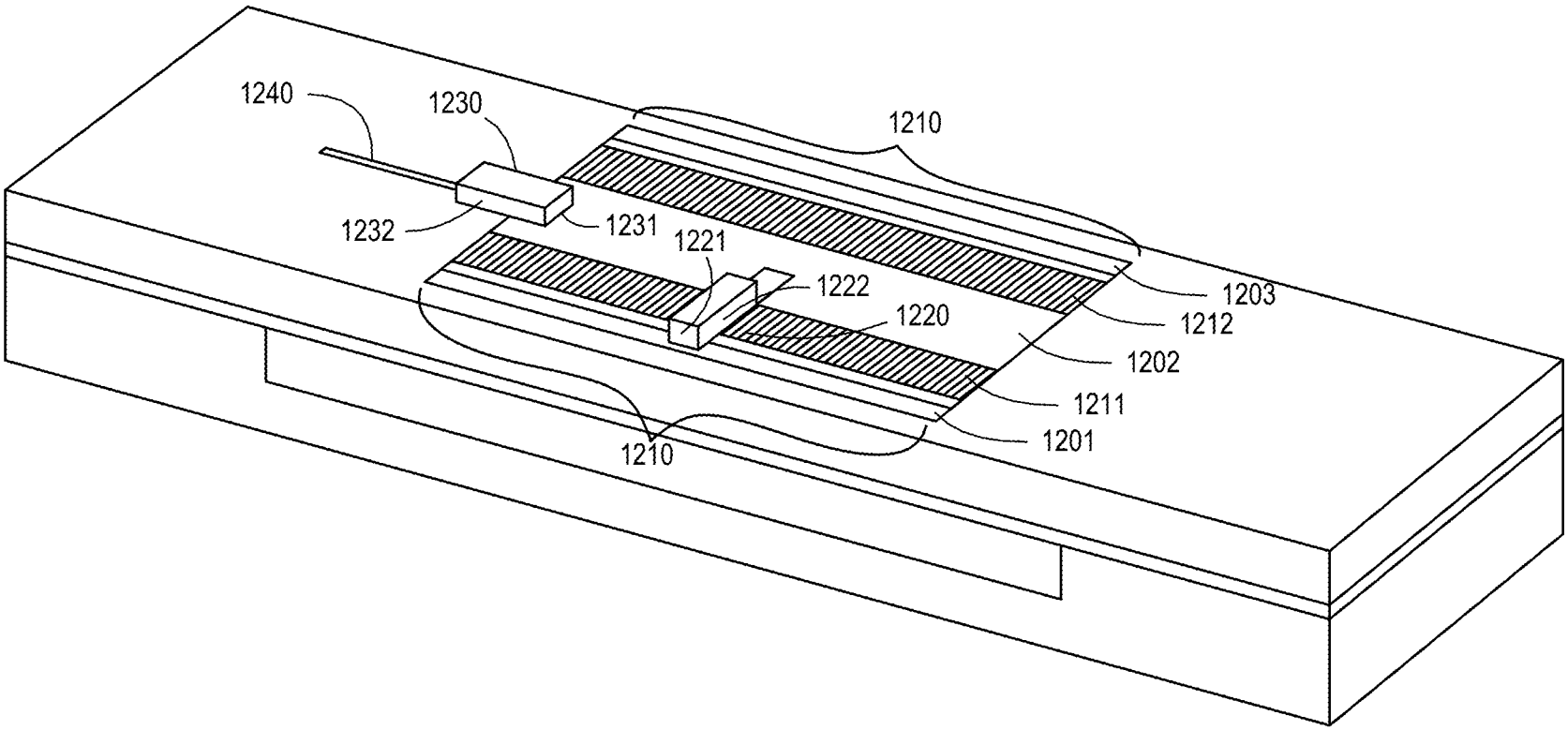
FIG. 12 depicts a second illustrative embodiment of a surface scattering antenna with lumped elements.

With reference now to FIG. 12, a second illustrative embodiment of a surface scattering antenna is depicted. The illustrative embodiment employs the same multilayer PCB depicted in FIG. 10A, but an alternative patch antenna design with an alternative layout of lumped elements. In particular, the patch antenna includes three sub-patches. The first sub-patch 1201 and the third sub-patch 1203 are shorted to the upper waveguide conductor 1206 by colonnades of vias; the second sub-patch 1202 is capacitively-coupled to the first and second sub-patches by first and second interdigitated capacitors 1211 and 1212. The patch includes a tunable two-port element (such as a PIN diode) implemented as a surface-mounted component 1220. The configuration is similar to that of FIG. 9C as discussed above: a first contact 1221 connects the lumped element to the first sub-patch 1201, and a second contact 1222 connects the lumped element to the second sub-patch 1202, so that the lumped element spans the first interdigitated capacitor 1211. A bias control line 1240 is connected to the second sub-patch 1202 through a surface-mounted RF/microwave choke 1230 having two contacts 1231 and 1232 that connect the choke to the second sub-patch 1202 and the bias control line 1240, respectively. As in the first illustrative embodiment, the bias voltage line 1240 extends beyond the transverse extent of the substrate-integrated via and is then connected by a through-via 1150 to bias control circuitry on the opposite side of the multi-layer assembly.

Figure 13:
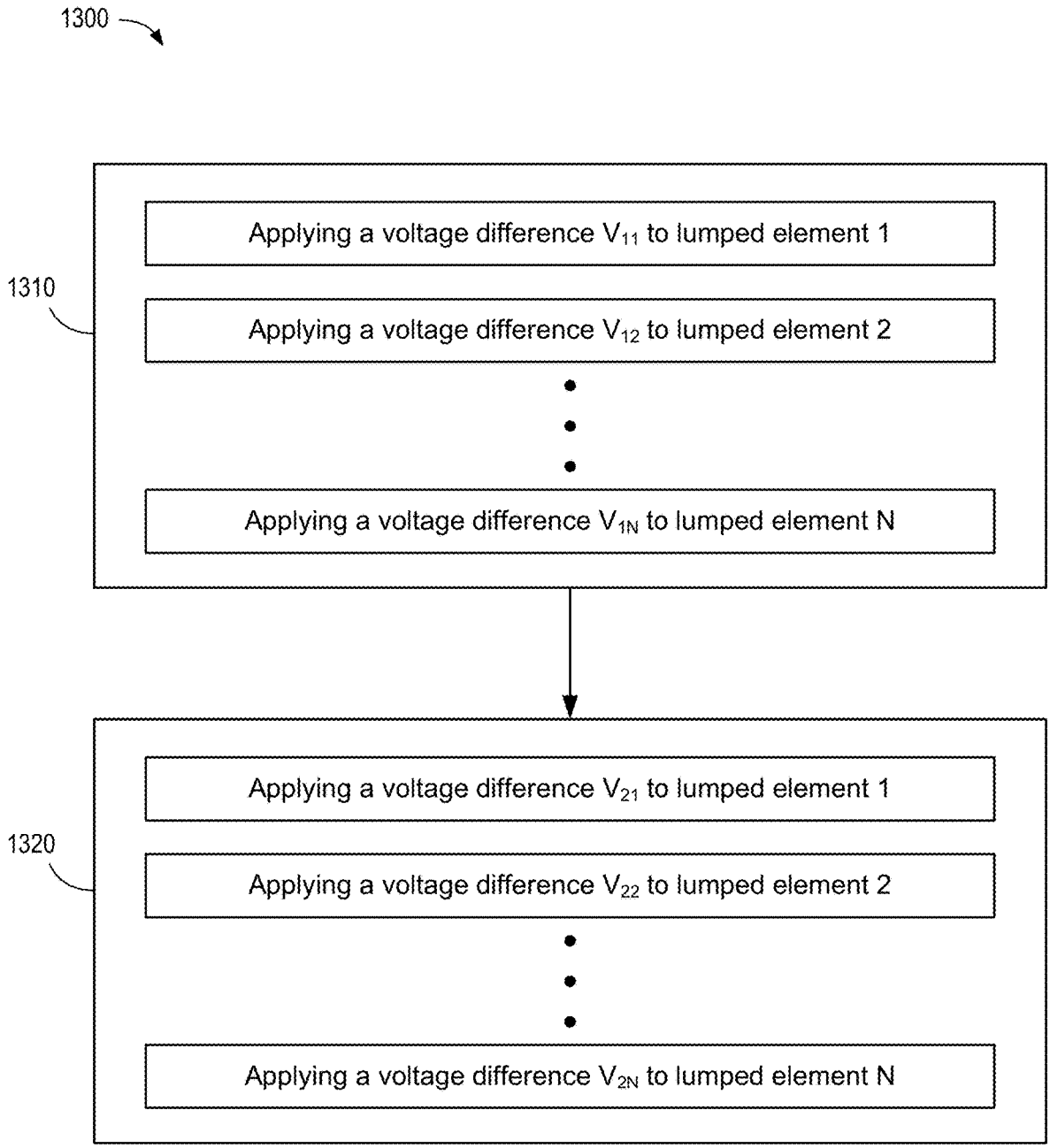
FIG. 13 depicts a flow diagram.

With reference now to FIG. 13, an illustrative embodiment is depicted as a process flow diagram. The process 1300 includes a first step 1310 that involves applying first voltage differences {Vn, V12, . . . , VIN} to N lumped elements, and a second step 1320 that involves applying second voltage differences {V21, V22, . . . , V2N} to the N lumped elements. For example, for a surface scattering antenna that includes N unit cells, with each unit cell containing a single adjustable lumped element, the process configures the antenna in a first configuration corresponding to the first voltage differences {Vn, V12, . . . , VIN}, and then the process reconfigures the antenna in a second configuration corresponding to the second voltages differences {Vn, V12, . . . , VIN}. The voltage differences can include, for example, voltage differences across two-port elements 830 such as those depicted in FIGS. 8A, 8C, 9A, and 9C, and/or voltage differences across pairs of terminals of three-port elements 833 such as those depicted in FIGS. 8B, 8D, 9B, and 9D.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna, comprising:

a planar waveguide;

a plurality of adjustable subwavelength radiative elements coupled to the waveguide at a non-uniform plurality of locations along the waveguide, wherein spacing between adjacent nearest-neighbor radiative elements is less than an operational wavelength of the antenna;

a plurality of metallic or dielectric structures positioned between each adjacent pair of adjustable subwavelength radiative elements to modify a nearest-neighbor coupling therebetween; and control circuitry to apply a modulation pattern to the plurality of adjustable subwavelength radiative elements based on the modified nearest-neighbor couplings of the adjustable subwavelength radiative elements non-uniformly located along the waveguide.

2. The antenna of claim 1, wherein the antenna defines an aperture, and the non-uniform plurality of locations is a plurality of locations randomly distributed across the aperture with a uniform probability distribution.

3. The antenna of claim 1, wherein the antenna defines an aperture, and the non-uniform plurality of locations is a plurality of locations randomly distributed across the aperture with a non-uniform probability distribution.

4. An antenna, comprising:

a waveguide;

adjustable subwavelength radiative elements coupled to the waveguide with a uniform spacing between adjacent adjustable subwavelength radiative elements; and a plurality of metallic or dielectric structures positioned between each adjacent pair of adjustable subwavelength radiative elements to modify a nearest-neighbor coupling therebetween, wherein variations in sizes of the metallic or dielectric structures in each plurality of metallic or dielectric structures between each respective pair of adjustable subwavelength radiative elements create non-uniform nearest-neighbor couplings between the uniformly spaced adjustable subwavelength radiative elements.

5. The antenna of claim 4, wherein the non-uniform plurality of nearest-neighbor couplings is a plurality of random nearest-neighbor couplings.

6. The antenna of claim 4, wherein the antenna defines an aperture and the non-uniform plurality of nearest-neighbor couplings varies gradually as a function of position on the aperture.

7. The antenna of claim 4, wherein the plurality of metallic or dielectric structures between each respective pair of adjustable subwavelength radiative elements is a plurality of via structures.

8. The antenna of claim 7, wherein the plurality of via structures is a plurality of via fences.

9. The antenna of claim 8, wherein the subwavelength elements include patch elements on a metal layer above a ground plane of the waveguide, and the via fences extend from the metal layer to the ground plane between adjacent pairs of the patch elements.

10. The antenna of claim 8, wherein the subwavelength elements include slots above cavities coupled to the waveguide, and the via fences delineate the cavities.

11. The antenna of claim 8, wherein the non-uniform plurality of nearest-neighbor couplings corresponds to a non-uniform plurality of lengths of the via fences.

12. The antenna of claim 8, wherein the non-uniform plurality of nearest-neighbor couplings corresponds to a non-uniform plurality of inter-via spacings of the via fences.

13. The antenna of claim 8, wherein the non-uniform plurality of nearest-neighbor couplings corresponds to a non-uniform plurality of via hole sizes of the via fences.

14. The antenna of claim 4, wherein the subwavelength elements include patch elements, and the plurality of metallic or dielectric structures between each respective pair of adjustable subwavelength radiative elements is a plurality of parasitic elements between adjacent pairs of the patch elements.

* * * * *